US009110405B2

(12) United States Patent
Wakisaka

(10) Patent No.: US 9,110,405 B2
(45) Date of Patent: Aug. 18, 2015

(54) IMAGE FORMING APPARATUS HAVING A DEVELOPER INSTALL MODE

(75) Inventor: Masashi Wakisaka, Tsukubamirai (JP)

(73) Assignee: CANON FINETECH INC., Misato-shi (JP)

( * ) Notice: Subject to any disclaimer, the term of this patent is extended or adjusted under 35 U.S.C. 154(b) by 211 days.

(21) Appl. No.: 13/328,534

(22) Filed: Dec. 16, 2011

(65) Prior Publication Data

US 2012/0155901 A1 Jun. 21, 2012

(30) Foreign Application Priority Data

Dec. 20, 2010 (JP) ..... 2010-283799
Nov. 15, 2011 (JP) ..... 2011-249450

(51) Int. Cl.
*G03G 15/06* (2006.01)
*G03G 15/08* (2006.01)
*G03G 15/09* (2006.01)

(52) U.S. Cl.
CPC ..... *G03G 15/0907* (2013.01); *G03G 15/065* (2013.01)

(58) Field of Classification Search
CPC ..... G03G 15/0907; G03G 15/065
USPC ..... 399/55, 253, 257, 258
See application file for complete search history.

(56) References Cited

U.S. PATENT DOCUMENTS 5,512,981 A * 4/1996 Hirsch ..... 399/49
5,594,539 A * 1/1997 Murano et al. ..... 399/316
7,076,182 B2 7/2006 Osawa et al.
7,340,189 B2 3/2008 Itagaki et al.
7,460,798 B2 12/2008 Toda et al.
8,036,544 B2 10/2011 Toda et al.
2002/0122673 A1* 9/2002 Sakai et al. ..... 399/27
2003/0081960 A1* 5/2003 Osawa et al. ..... 399/55
2003/0202806 A1* 10/2003 Katoh et al. ..... 399/27
2006/0182456 A1* 8/2006 Naoi et al. ..... 399/50
2006/0198644 A1* 9/2006 Itagaki et al. ..... 399/27
2009/0142078 A1* 6/2009 Niijima ..... 399/27
2011/0280594 A1* 11/2011 Tanaka ..... 399/27

FOREIGN PATENT DOCUMENTS

JP 5-46027 A 2/1993
JP 2001075341 A * 3/2001
JP 2002-244413 A 8/2002

(Continued)

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image forming apparatus includes an image bearing member, a charging device which charges the image bearing member, an exposure device which exposes the charged image bearing member to light, a developing device having a developer carrying member, and developing the electrostatic latent image by supplying the developer from the developer carrying member, and an instructing portion which generates an instruction signal for instructing to perform a developer install mode for installing developer in the developing device at a time of non-image formation. In the developer install mode a control portion sets an absolute value of a potential on the image bearing member charged by the charging device to a value which is smaller than an absolute value of a potential of the developer carrying member caused by a direct current component of the bias to be applied to the developing device and larger than an absolute value of an image dark section potential on the image bearing member at the time of image formation.

20 Claims, 14 Drawing Sheets

(56) References Cited

FOREIGN PATENT DOCUMENTS

| | | | | |
|---|---|---|---|---|
| JP | 2004-170650 | A | | 6/2004 |
| JP | 2005062487 | A | * | 3/2005 |
| JP | 2005308900 | A | * | 11/2005 |
| JP | 2006-126801 | A | | 5/2006 |
| JP | 2006-243115 | A | | 9/2006 |

* cited by examiner

IMAGE FORMING APPARATUS HAVING A DEVELOPER INSTALL MODE

BACKGROUND OF THE INVENTION

1. Field of the Invention

The present invention relates to an image forming apparatus that forms an image by charging an image bearing member by a charging device having a bias voltage applied thereto and supplying a developer to the image bearing member by a developer carrying member having a bias voltage applied thereto.

2. Description of the Related Art

A conventionally known image forming apparatus irradiates a uniformly charged photosensitive member with laser light to form an electrostatic latent image thereon, develops the electrostatic latent image with toner carried by a developing roller to form a toner image, and transfers and fixes the toner image to a transfer material to form an image thereon.

In the conventional image forming apparatus, a developing device which forms a toner image on the photosensitive member includes, for example, an agitating member which agitates toner while transporting the toner, a layer regulating member which regulates a toner layer on the developing roller, and a toner remaining amount detection element, in addition to the developing roller. The toner in the developing device reaches a predetermined charge amount due to the friction charging caused by the agitation by the agitating member and the rotation of the developing roller. Then, after a toner layer is formed uniformly by the layer regulating member, the toner is transported to a developing region opposed to the photosensitive member by the rotating developing-roller to develop an electrostatic latent image with or without contact to the photosensitive member.

The development of toner depends upon a toner charge and a developing electric field. If the toner charge is high, the toner can be developed onto the photosensitive member even when the developing electric field is low.

Further, the characteristics such as chargeability of toner that is a powder particle are varied depending upon respective toner particle diameters. Therefore, all the toner particles are not charged by friction to a desired charge amount, and the charge amount has a distribution (a certain range) with a desired charge amount as a peak.

Further, when the toner in the developing device is supplied to the photosensitive member and the toner is consumed for image formation, toner is replenished from a developer replenishment container to the developing device according to the detection result of the toner remaining amount detection element. For example, as described in Japanese Patent Application Laid-Open No. H05-46027, at a time of setting a developing device to be used for the first time, an operation of replenishing toner to the developing device containing no toner is performed. Specifically, at a time of a toner install (setting sequence) for replenishing toner to the developing device containing no toner, toner continues to be replenished from the developer replenishment container to the developing device until a toner amount in the developing device reaches an appropriate amount. At this time, simultaneously, in order to make the toner in the developing device to have a desired charge amount, an operation of rotating the developing roller is also performed during the replenishment of toner.

However, according to the related art, toner continues to be replenished to the developing device successively at a time of setting the developing device to be used for the first time. Therefore, it is difficult to make toner replenished first and toner replenished later to have a uniform charge amount in the developing device, and toner having an excessive charge amount higher than an appropriate value and toner having a small charge amount lower than the appropriate value are mixed. FIG. 3A shows a toner charge amount distribution on the developing roller immediately after the start of the setting sequence and a toner charge amount distribution on the developing roller after the end of the setting sequence. For measuring the toner charge amount distribution, E-SPART produced by Hosokawa Micron Corporation was used.

As shown in FIG. 3A, when toner having a charge amount higher than the appropriate value and toner having a charge amount lower than the appropriate value are mixed, electrostatic aggregation of toner having an excessive charge amount and toner having a small charge amount occurs, which causes insufficient formation of a toner layer on the developing roller. Then, when a toner layer formation defect occurs on the developing roller due to the electrostatic aggregation at a time of initial image formation after setting of the developing device, the amount of toner applied in a layer formation defective portion becomes large. Therefore, a larger amount of toner flies to the photosensitive member as compared to the other portion of the developing roller. Thus, a defective image such as flecks and streaks is generated on the transfer material in a rotation period of the developing roller, as shown in FIG. 3B. The electrostatic aggregation occurs particularly in a low-humidity environment in which the charge amount of toner tends to become high.

SUMMARY OF THE INVENTION

The present invention has been made by further improving the above-mentioned related art, and an object thereof is to reduce toner having an excessive charge amount, which causes electrostatic aggregation at a time of replenishment of toner, to thereby reduce a defective image caused by the electrostatic aggregation of toner.

In order to achieve the above-mentioned object, the present invention provides an image forming apparatus, including:

- an image bearing member;
- a charging device which charges the image bearing member to a predetermined potential uniformly;
- an exposure device which exposes the charged image bearing member to light according to an image signal to form an electrostatic latent image on the image bearing member in accordance with an image;
- a developing device including a developer carrying member which supplies developer to the image bearing member, and developing the electrostatic latent image by supplying the developer from the developer carrying member;
- an instructing portion which generates an instruction signal for instructing to perform a developer install mode for installing developer in the developing device at a time of non-image formation; and
- a control portion which adjusts a potential difference between the image bearing member and the developer carrying member in the developer install mode in response to the instruction signal from the instructing portion,
  - wherein the control portion adjusts the potential difference between the image bearing member and the developer carrying member in the developer install mode to a value smaller than a potential difference between an image dark section potential on the image bearing member and the developer carrying member at a time of image formation. Further features of the present invention will become apparent from the following description of exemplary embodiments with reference to the attached drawings.

DESCRIPTION OF THE EMBODIMENTS

Hereinafter, exemplary embodiments of the present invention will be described in detail illustratively with reference to the drawings. Note that, the dimensions, materials and shapes of components, and the relative arrangements thereof described in the following embodiments are to be modified appropriately depending upon the configuration and various conditions of an apparatus to which the present invention is applied. Thus, unless otherwise described particularly, the scope of the present invention is not limited only thereto.

(First Embodiment)

Figure 1:
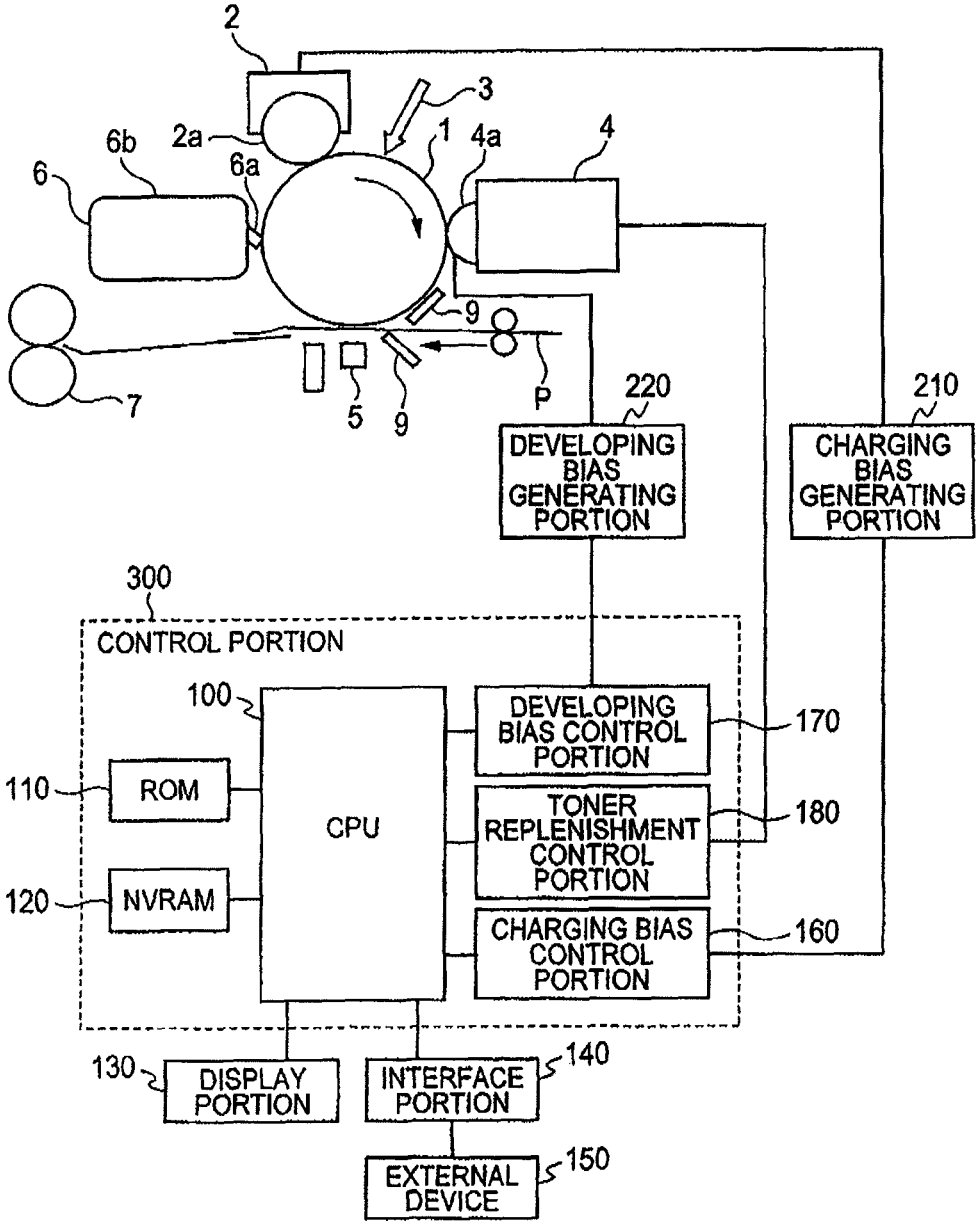
FIG. 1 is an explanatory schematic view illustrating an image forming apparatus according to a first embodiment.

An image forming apparatus according to a first embodiment will be described. FIG. 1 is a schematic view illustrating a configuration of the image forming apparatus according to the first embodiment. As illustrated in FIG. 1, the image forming apparatus includes a photosensitive member 1 that is an image bearing member having an organic photoconductive photosensitive layer. Further, a charging device (charging unit) 2, an exposure device (exposure unit) 3, a developing device (developing unit) 4, and a cleaning device (cleaning unit) 6, which serve as process devices (process unit) acting on the photosensitive member 1, are provided around the photosensitive member 1. Further; there are provided a transfer device (transfer unit) 5 that transfers a toner image formed on the photosensitive member 1 to a transfer material and a fixing device 7 that fixes the toner image transferred to the transfer material.

An image forming operation by the image forming apparatus will be described. The charging device 2 has a charging roller 2*a* having a charging bias applied thereto to charge the photosensitive member 1 to a predetermined surface potential uniformly. The surface of the photosensitive member 1 is charged uniformly by the charging roller 2*a* of the charging device 2 so that the photosensitive member 1 is charged to a predetermined potential. Next, the photosensitive member 1 is exposed to light according to image information (image signal) in the exposure device 3 so that an electrostatic latent image according to the image information is formed on the photosensitive member 1.

The developing device 4 has a developing roller 4*a* serving as a developer carrying member having a developing bias applied thereto to supply developer to the photosensitive member 1. In the developing device 4, the electrostatic latent image on the photosensitive member 1 is developed with toner serving as developer. In the developing device 4, toner dropped from a developer replenishment container 46 is transported into a developing container 40 by a screw 4*c*, and is further transported toward the developing roller 4*a* while being agitated by an agitating member 4*d*. The developing roller 4*a* is a developer carrying member in which a rotatable sleeve is placed on the outer circumference of a plurality of fixed magnetic poles. The toner carried by the developing roller 4*a* is regulated into a uniform layer thickness by a layer regulating member 4*b*, and then transported to a developing region to develop the electrostatic latent image in or out of contact with the photosensitive member 1.

The transfer device 5 transfers the toner image developed on the photosensitive member 1 by the developing device 4 onto a sheet that is a transfer material transported to a transfer region opposed to the photosensitive member 1. Transfer guides (transfer material guide members) 9 for guiding the sheet to a nip portion of the photosensitive member 1 and the transfer device 5 are provided in the vicinity of the nip portion. The transfer device 5 may be any one of an electrostatic transfer system and a bias transfer system. According to the electrostatic transfer system, the transfer device 5 which generates direct current corona discharge is placed so as to be opposed to the photosensitive member 1 via the sheet, and the direct current corona discharge is allowed to act on the sheet from the back side of the sheet. Thus, the toner image carried on the photosensitive member 1 is transferred onto the sheet.

The sheet with the toner image transferred thereon by the transfer device 5 is sent to the fixing device 7, and the toner image is fixed on the sheet by fixing processing. Then, the sheet is discharged out of the device.

Meanwhile, residual toner remaining on the photosensitive member 1 that has finished the transfer step is removed by the cleaning device 6 and collected. The cleaning device 6 has a cleaning blade 6*a* serving as a cleaning member placed in contact with the surface of the photosensitive member 1 and scrapes off the residual toner by the cleaning blade 6*a* rubbing against the surface of the photosensitive member 1. Further, the cleaning device 6 has a cleaning container 6*b* serving as a collecting member which collects developer, and collects the residual toner scraped off by the cleaning blade 6*a*. Further, the cleaning device 6 has a scooping sheet 6*c* (see FIGS. 13A and 13B) that prevents the leakage of toner collected in the cleaning container 6*b*. The scooping sheet 6*c* comes into contact with the surface of the photosensitive member 1 on an upstream side in a rotation direction of the photosensitive member 1 relative to the cleaning blade 6*a* and scoops toner collected by the cleaning blade 6*a* to prevent the toner from scattering.

As illustrated in FIG. 1, the image forming apparatus has a control portion (control unit) 300 having a CPU 100. Hereinafter, the control portion 300 will be described.

A memory device is provided in the control portion 300. The memory device is not particularly limited, and a well-known electronic memory can be used suitably. As the memory, various forms can be adopted, such as a non-volatile memory and a combination of a volatile memory and a backup battery. Here, the memory includes a ROM 10 that stores preset information described later and an NVRAM 120 in which the detection result of a toner remaining amount can be written.

Further, a display portion 130 is provided in the image forming apparatus. Further, there is provided an interface portion 140 which connects the image forming apparatus main body to an external device 150 such as a personal computer so that the image forming apparatus and the external device 150 can communicate with each other. The display portion 130 and the interface portion 140 are each connected to the CPU 100 of the control portion 300.

Further, the control portion 300 includes a charging bias control portion 160, a developing bias control portion 170, and a toner replenishment control portion 180, each of which is connected to the CPU 100. As described later, the control portion 300 controls biases applied to the charging roller 2*a* and the developing roller 4*a*, respectively, via the charging bias control portion 160 and the developing bias control portion 170.

Figure 2:
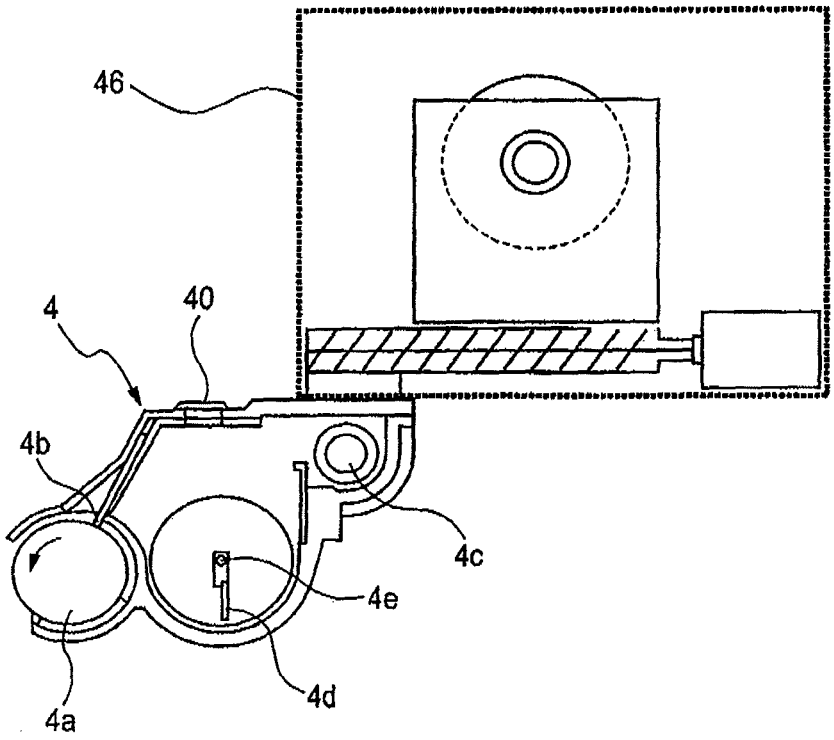
FIG. 2 is an explanatory view illustrating a configuration of a developing device.

As illustrated in FIG. 2, a toner remaining amount detection element (developer remaining amount detection unit) 4*e* which detects the remaining amount of toner in the developing container 40 is provided inside the developing container 40 in the developing device 4. Based on the detection result of the toner remaining amount detection, element 4*e*, toner is replenished from the developer replenishment container 46 to the developing container 40.

When the toner remaining amount detection element 4*e* outputs a signal indicating the shortage of toner to the CPU 100, the CPU 100 outputs a signal to the toner replenishment control portion 180 to allow the developer replenishment container 46 to drop toner. Then, the toner is transported by the screw 4*c* to be replenished to the developing container 40. Further, when the toner is replenished from the developer replenishment container 46 to the developing container 40, and the toner remaining amount detection element 4*e* outputs, to the CPU 100, a signal indicating that the developing container 40 is filled with the toner, the CPU 100 outputs a signal to the toner replenishment, control portion 180 to stop the supply of the toner.

The control portion 300 includes the charging bias control portion 160 and is capable of outputting a direct current bias and an alternate current bias serving as a charging bias to the charging roller 2*a* via a charging bias generating portion 210. When the charging roller 2*a* has a charging bias applied thereto, the photosensitive member 1 can be uniformly charged to a predetermined surface potential. Here, in the case where a direct current bias of −570 V and an alternate current bias with an amplitude of 1,500 V at a sine wave having a frequency of 1,200 Hz are applied to the charging roller 2*a* by the charging bias generating portion 210, the photosensitive member 1 is charged to −550 V.

Similarly, the control portion 300 includes the developing bias control portion 170 and is capable of outputting a direct current bias and an alternate current bias serving as a developing bias to the developing roller 4*a* via a developing bias generating portion 220. When the developing roller 4*a* has a developing bias applied thereto, toner on the developing roller 4*a* can be developed onto an electrostatic latent image of the photosensitive member 1. Here, a direct current bias of −400 V and an alternate current bias with an amplitude of 800 V at a rectangular wave having, a frequency of 2,400 Hz are applied to the developing roller 4*a* by the developing bias generating portion 220. The developing bias to be applied to the developing roller 4*a* is applied with a direct current component (direct current bias) and an alternate current component (alternate current bias) superimposed on each other during an image forming operation. On the other hand, as described later, during a potential control sequence, only the direct current component (direct current bias) is applied, unlike the image forming operation.

Figure 3A:
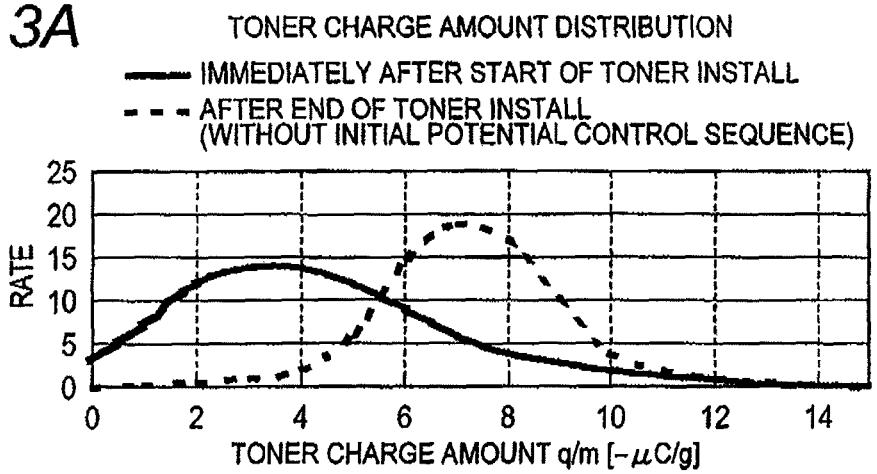
FIG. 3A is a graph showing a toner charge amount distribution on a developing roller at a time of setting the developing device.
Figure 3B:
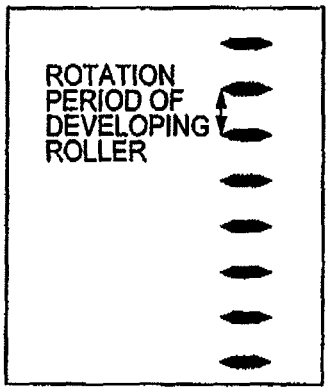
FIG. 3B is a view illustrating a defective image generated due to the electrostatic aggregation of toner on the developing roller.
Figure 3C:
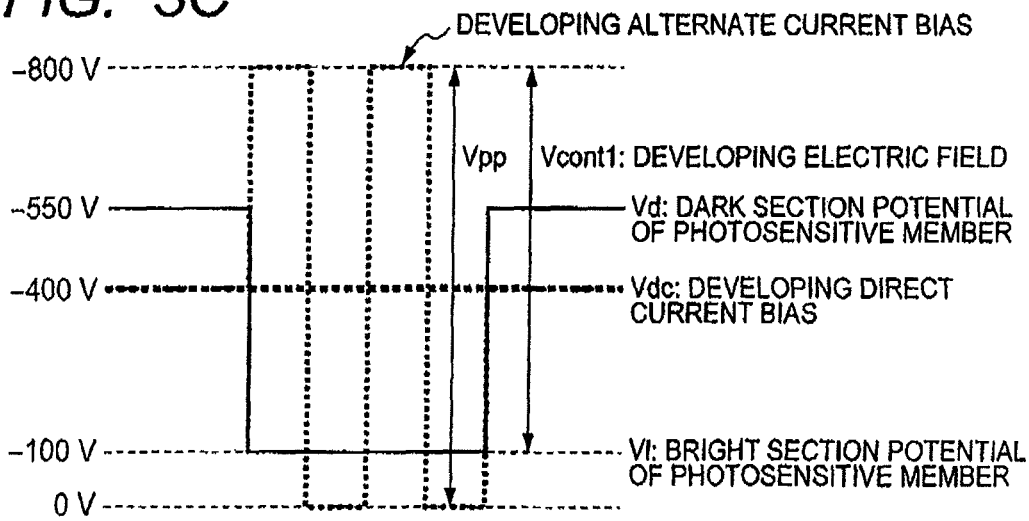
FIG. 3C is a diagram illustrating a relationship between a surface potential of a photosensitive member and a developing bias at a time of forming an image.

FIG. 3C is a diagram illustrating a relationship between a surface potential of the photosensitive member 1 and a bias voltage to be supplied to the developing roller 4*a* in the image forming operation (at a time of forming an image) of the image forming, apparatus. FIG. 3C is a diagram illustrating a concept of a developing electric field, and assuming that a dark section potential of the photosensitive member is Vd, a bright section potential thereof is Vl, and a peak-to-peak voltage of the developing bias alternate current component is Vpp, and a potential of the direct current component is Vdc, a developing electric field Vcont1 at the time of forming an image is expressed by the following expression:

$$V\text{cont}1=(1/2)Vpp+|Vdc|-|Vl|$$

Here, the dark section potential Vd of the photosensitive member 1 is set to be −550 V based on FIG. 3C. If the photosensitive member 1 is exposed to light by the exposure device 3 when the surface of the photosensitive member 1 is charged uniformly as described above, charge is generated inside the photosensitive member 1, and thus, the photosensitive member 1 is changed from a state in which the photosensitive member 1 is charged to 550 V to a state in which the photosensitive member 1 is charged to −100 V. Therefore; the surface potential of the photosensitive member 1 is changed from −550 V (dark section potential Vd) to −100 V (bright section potential Vl). Further, the reason for setting Vpp to be ½ in the above-mentioned expression is that Vpp is a rectangular wave having a positive component and a negative component, and only the negative component contributes to the developing electric field. Further, the direct current bias voltage Vdc of the developing roller 4*a* is set to be −400 V and the alternate current bias voltage Vpp thereof is set to be 800 V. Therefore, the developing electric field. Vcont1 during the image forming operation is 700 V. The bright section potential V of the photosensitive member 1 is a potential of an area corresponding to an image dark section (an image portion on which developer is borne) on the photosensitive member 1. That is, the developing electric field Vcont1 at the time of image formation is a potential difference between the area (the bright section potential Vl of the photosensitive member) corresponding to the image dark section on the photosensitive member 1 at the time of image formation and the developing roller 4*a*.

In the above-mentioned image forming apparatus, at a time of non-image formation, for example, at a time of setting the developing device 4 to be used for the first time, toner continues to be replenished from the developer replenishment container 46 to the developing container 40 of the developing device 4 successively. At this time, in the developing container 40, the charge amount cannot be made uniform between the toner replenished first and the toner replenished later, and toner having a charge amount higher than an appropriate value and toner having a charge amount lower than the appropriate value may be mixed. Then, the toner having an excessive charge amount which is higher than the appropriate value and the toner having a small charge amount which is lower than the appropriate value aggregate electrostatically, and a defective image such as flecks and streaks may be generated on a transfer material in a rotation period of the developing roller 4*a*.

Thus, in the image forming apparatus of the present invention, at the time of the replenishment of toner (at the time of non-image formation), when a user or a service personnel performs an operation from the display portion 130 or an external device 150 such as a personal computer, an instruction signal for instructing to perform the developer install mode for replenishing the developing device 4 with toner is input from the display portion 130 or the external device 150 to the CPU 100 in the control portion 300. In time with the start of replenishment of the developing device 4 with the toner, the CPU 100 adjusts a potential difference between the image bearing member and the developer carrying member. The control portion 300 adjusts one or both of biases to be applied to the charging device and the developer carrying member to generate, between the developing roller and the photosensitive member, a developing electric field Vcont2 smaller than the developing electric field Vcont1 during an image forming operation. That is, the CPU 100 adjusts the developing electric field Vcont2 which is the potential difference between the photosensitive member 1 and the developing roller 4*a* at the time of the developer install mode to a value smaller than the developing electric field Vcont1 which is the potential difference between the area of the bright section potential Vl of the photosensitive member 1 at the time of image formation and the developing roller 4*a*. This can remove the toner having an excessive charge amount by developing (supplying toner having an excessive charge amount from the developing roller to the photosensitive member), and the toner having an excessive charge amount that causes the electrostatic aggregation during the replenishment of toner can be reduced.

Figure 4:
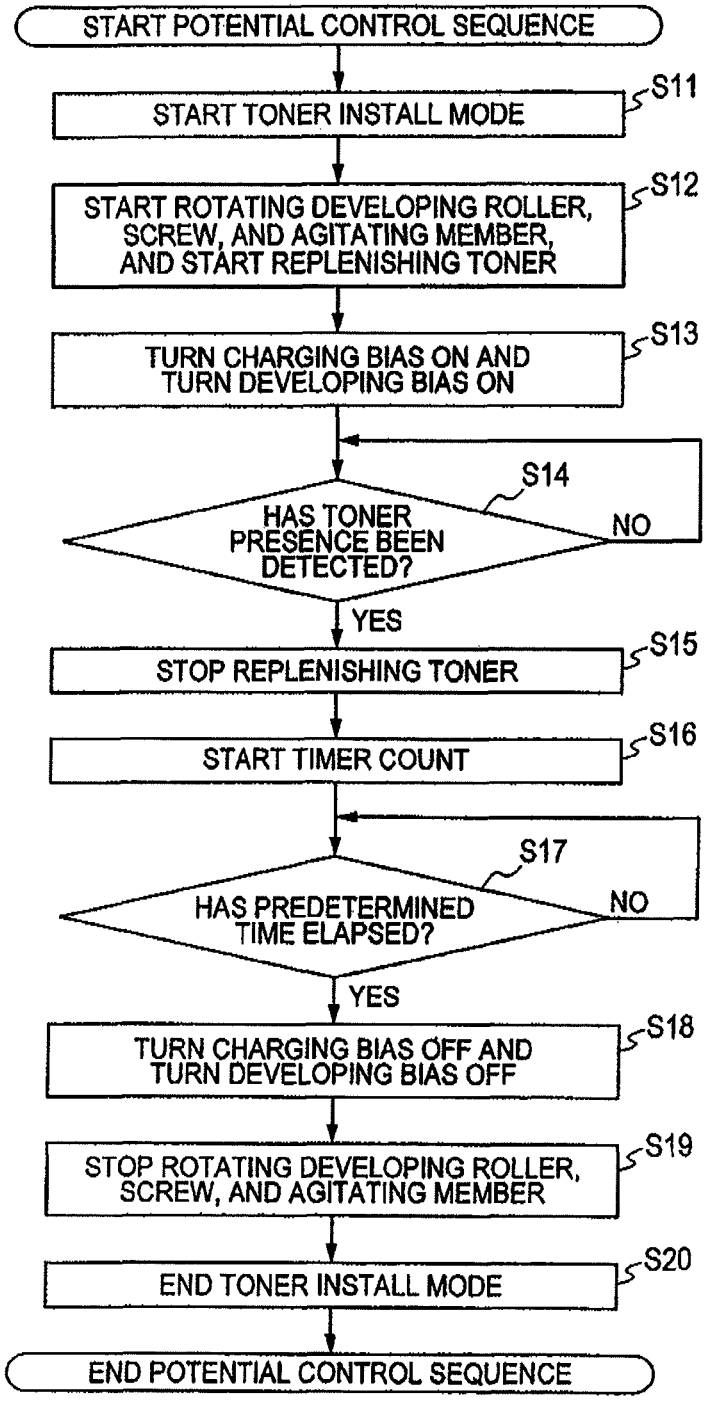
FIG. 4 is a flowchart illustrating a potential control sequence according to the first embodiment.

The potential control sequence for performing the above developer install mode is performed in accordance with a flowchart of FIG. 4. The control portion 300 performs the steps designated by the reference signs S11 to S20 in FIG. 4.

When the control portion 300, starts the potential control sequence, in order to use the developing device for the first time; the control portion 300 starts the toner install mode for replenishing toner from the developer replenishment container 46 into the developing container 40 (S11). The control portion 300 (see FIG. 1) performs the potential control sequence so as to successively replenish toner (developer) from the developer replenishment container 46 to the developing container 40 at the time of setting the developing device 4 to be used for the first time.

Next, the control portion 300 starts the rotation of the developing roller 4*a*, the screw 4*c*, and the agitating member 4*d*, and at the same time, based on the detection result of the toner remaining amount detection element 4*e*, the control portion 300 intermittently replenishes toner from the developer replenishment container 46 to the vacant developing container 40 (S12).

Then, the control portion 300 applies a charging bias to the charging roller and applies only the direct current bias of the developing biases to the developing roller (S13) so that a second developing electric field Vcont2 (see FIG. 5B) different from the developing electric field Vcont1 during the image forming operation is created. Thus, only the toner having an excessive charge amount is selectively transferred (developed) from the developing roller to the photosensitive member so that toner having a charge amount within an appropriate range (between plus and minus predetermined values with respect to a peak value) is not transferred (developed). That is, when toner is replenished during the potential control sequence, the control portion 300 performs control to set the second developing electric field Vcont2 smaller than the first developing electric field Vcont1 during the image forming operation. Assuming that the potential of the photosensitive member charged by the charging roller during the potential control sequence is Vset, the developing electric field Vcont2 is expressed by the following expression:

$$V\text{cont2} = |Vdc'| - |V\text{set}|$$

$$V\text{cont1} > V\text{cont2} > 0$$

The second developing electric field Vcont2 is a developing electric field that allows the photosensitive member 1 to carry toner (toner having an excessive charge amount) having charge larger by a predetermined value than the peak value of the charge amount of the toner carried by the developing roller 4*a*. Further, the second developing electric field Vcont2 is not only smaller than the first developing electric field Vcont1 during the image forming operation, but also is larger than 0. That is, the absolute value of the developing direct bias Vdc' is larger than the absolute value of the surface potential Vset of the photosensitive member 1. This is because, if the second developing electric field Vcont2 is smaller than 0, the direction of the developing electric field is reversed, and this direction is a direction in which toner flies from the photosensitive member to the developing roller, not a direction in which toner flies from the developing roller to the photosensitive member.

Figure 5A:
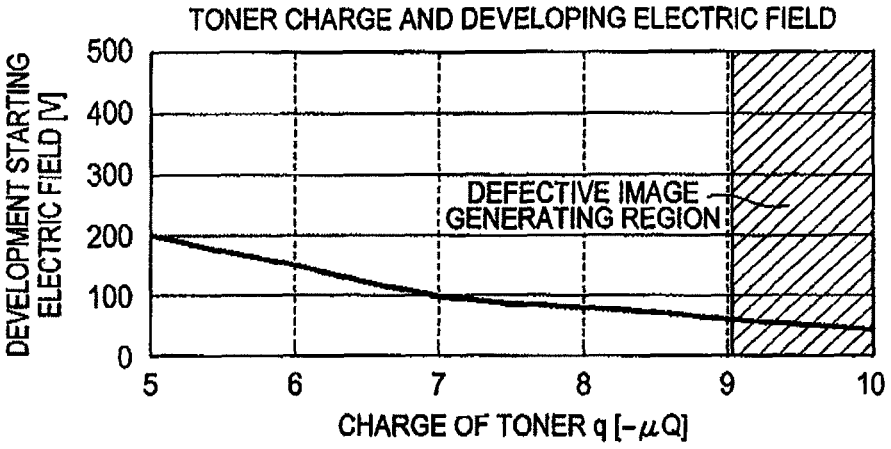
FIG. 5A is a graph showing a relationship between a charge of toner and a developing bias required for developing the toner having the charge.
Figure 5B:
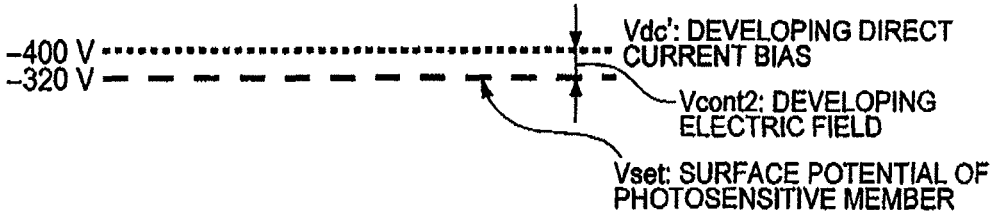
FIG. 5B is a diagram illustrating a relationship between a surface potential of the photosensitive member and a developing bias at a time of the potential control sequence.

More specifically, in S13, the charging bias and the direct current bias of the developing bias to be applied are derived from a relationship between the toner charge amount and the development starting electric field with reference to FIG. 5A. Further, it is preferred that the developing bias to be applied be only a direct current bias having a low developing property, which accelerates the selective development of a highly charged toner. FIG. 5A shows a development starting electric field required for transferring the toner having charge on the developing roller 4*a* onto the photosensitive member 1 for development. When the developing roller 4*a* continues to rotate, the charge amount of the toner on the developing roller 4*a* also increases. Here, when toner having a charge amount of −9 μC or larger is present, a defective image is caused. Thus, the charging bias and the developing bias are adjusted and applied so that the charge amount is −8 μC, that is, the developing electric field Vcont2 is 80 V in such a manner that the charge amount does not become −9 μC or larger. Here, by adjusting only the charging bias, a developing electric field Vcont2 of 80 V is created. That is, by fixing the developing direct current bias Vdc at −400 V and setting the charging bias to be −340 V, the surface potential Vset of the photosensitive member 1 becomes −320 V, and thus, the developing electric field Vcont2 of 80 V can be created. FIG. 5B shows a relationship between the surface potential of the photosensitive member 1 and the developing bias to be applied to the developing roller 4*a* at this time. Here, as a structure which adjusts the potential difference Vcont2 at the time of developer install mode to a value smaller than the potential different Vcont1 at the time of image formation, the structure which sets the absolute value of the potential Vset on the photosensitive member to a value smaller than the absolute value of the potential Vdc' of the developing roller is explained. However, the invention is not limited to the structure. In a case that the potential Vdc' of the developing roller at the time of the developer install mode is the same value as the potential Vdc of the developing roller at the time of image formation, the absolute value of the potential Vset on the photosensitive member may be set at a value larger than the absolute value of the potential Vl of the image dark section of the photosensitive member at the time of image formation.

At this time, only a highly charged toner on the developing roller 4*a* is developed over the entire developing region of the photosensitive member 1 and collected by the cleaning device 6. Thus, the toner having a charge amount within an, appropriate range (up to a predetermined value above or below the peak value) remains on the developing roller 4*a*. By removing the toner having an excessive charge amount, the electrostatic aggregation of the toner is reduced, and a defective image caused by the electrostatic aggregation is also reduced.

When the control portion 300 determines that the toner remaining amount detection element 4*e* has detected the toner presence (S14), the control portion 300 stops the replenishment of the toner (S15). After the stop of the replenishment, the control portion 300 starts a timer count (S16), and the developing roller 4*a*, the screw 4*c*, and the agitating member 4*d* continue to perform idle rotations for a predetermined period of time to stabilize the charge amount of toner.

Then, when the control portion 300 determines that the predetermined period of time has elapsed (S17), the control portion 300 stops the application of the charging bias and the developing direct current bias (S18). At the same time, the control portion 300 stops the rotation of the developing roller 4*a*, the screw 4*c*, and the agitating member 4*d* (S19) to end the toner install mode (S20), and thus, the control portion 300 ends the potential control sequence.

Figure 5C:
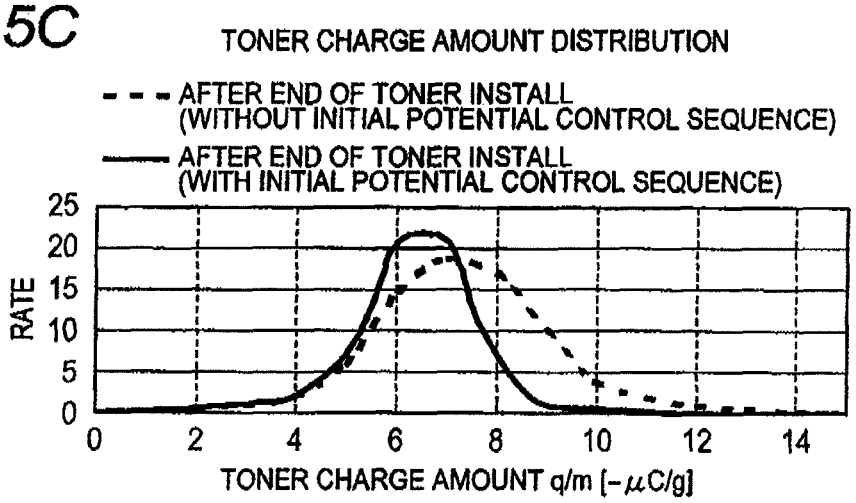
FIG. 5C is a graph showing a charge amount distribution of toner on the developing roller after setting the developing device with and without the potential control sequence.

FIG. 5C shows a toner charge amount distribution with and without the above-mentioned initial potential control sequence. By performing the above-mentioned initial potential control sequence, at the time of the replenishment of toner, the toner having an excessive charge amount that causes the electrostatic aggregation can be supplied from the developing roller to the photosensitive member so as to be removed from the developing device. Thus, compared with the case without the potential control sequence, the toner having an excessive charge amount can be reduced, and it can be confirmed that the toner charge amount distribution is within the appropriate range (up to a predetermined value above or below the peak value). Thus, as the control portion, at a time of the potential control sequence mode, sets the bias to be applied to one or both of the charging device and the developer carrying member so that a surface potential of the image bearing member becomes smaller than a potential of the developer carrying member and a difference between both potentials becomes smaller than a difference between a surface potential of the image bearing member and a potential of the developer carrying member at a time of an image forming operation, the electrostatic aggregation of the toner having an excessive charge amount and the toner having a small charge amount can be reduced, and the occurrence of a defective image such as flecks and streaks in a rotation period of the developing roller caused by the electrostatic aggregation can be reduced.

(Second Embodiment)

An image forming apparatus according to a second embodiment will be described.

In the sequence performed in the first embodiment, in which only toner having a certain high charge amount or more is developed onto the photosensitive member, the charge amount has a wide distribution at a low peak value when the number of revolutions of a developing roller is small, and hence, the effect thereof is insufficient.

Therefore, in the second embodiment, toner having a charge amount higher than the peak of an appropriate charge amount according to the cumulative number of revolutions of the developing roller is developed onto the photosensitive member. Thus, only toner having a charge amount within an appropriate range (up to a predetermined value above or below the peak value) remains in a developing device, which prevents a defective image caused by electrostatic aggregation of toner.

In the second embodiment, a control portion (control unit) 400 changes a developing electric field Vcont2 in a potential control sequence so as to increase in stages, every time the cumulative number of revolutions of the developing roller in the potential control sequence reaches a predetermined cumulative number of revolutions. Here, the toner is successively replenished to the developing device at a time of setting the developing device to be used for the first time, and the developing electric field Vcont2 is adjusted, with a period being divided into an initial period, an intermediate period, and a later period, until the replenishment is ended.

Specifically, the developing electric field Vcont2 in the initial period of the cumulative number of revolutions of the developing roller is designated by Vcont221, the developing electric field Vcont2 in the intermediate period of the cumulative number of revolutions of the developing roller is designated by Vcont222, and the developing electric field Vcont2 in the later period of the cumulative number of revolutions of the developing roller is designated by Vcont223. The control portion 400 controls a bias to be applied to a charging roller and a bias to be applied to the developing roller so that those developing electric fields Vcont2 satisfy the following relationships under the condition that the developing electric fields Vcont2 satisfy the above-mentioned relationships of the first embodiment:

$$V\text{cont1} > V\text{cont222} \geq V\text{cont221}$$

$$V\text{cont1} > V\text{cont222} \geq V\text{cont223}$$

Figure 6:
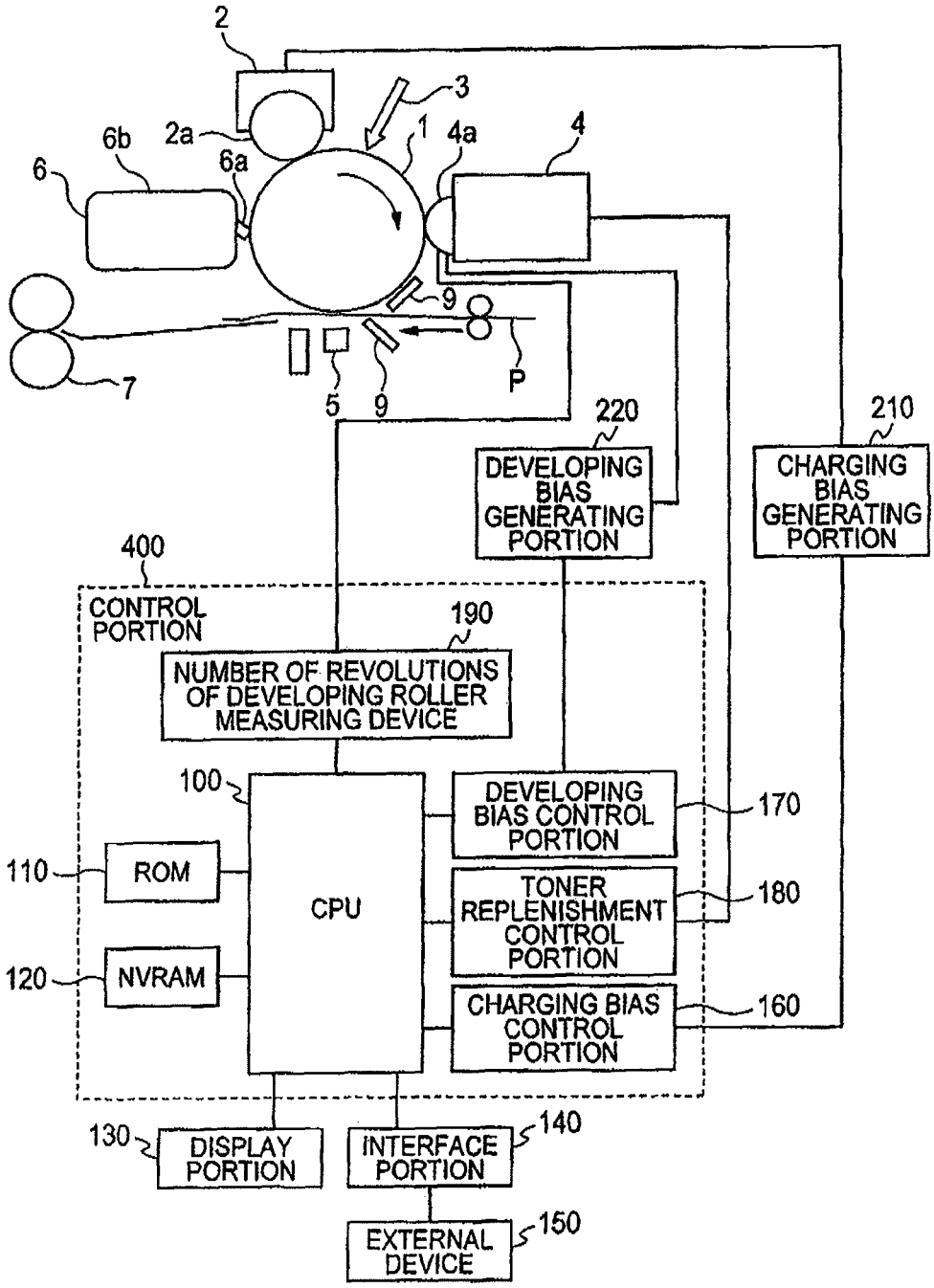
FIG. 6 is an explanatory schematic view illustrating an image forming apparatus according to a second embodiment.

Hereinafter, a description is made in detail with reference to the drawings. FIG. 6 is a schematic view illustrating a configuration of the image forming apparatus according to the second embodiment. Portions similar to those of the configuration of the first embodiment illustrated in FIG. 1 are designated by the same reference numerals as those thereof, and description thereof is omitted.

In this embodiment, as illustrated in FIG. 6, the control portion 400 includes a number of revolutions of developing roller measuring device (number of revolutions of developing roller measuring unit) 190 that measures the cumulative number of revolutions of the developing roller from the start of the replenishment of developer. The cumulative number of revolutions of the developing roller from the start the toner replenishment, which is measured by the number of revolutions of developing roller measuring device 190, is stored in the NVRAM120 serving as a storage device. The other configuration is the same as that of the above-mentioned first embodiment. Therefore, members having the same functions as those of the members of the above-mentioned first embodiment are designated by the same reference numerals, and description thereof is omitted.

Next, the potential control in the image forming apparatus according to this embodiment will be described. The potential control sequence at a time of replenishment according to this embodiment is performed for control in accordance with flowcharts of FIGS. 7 and 9. The control portion 400 performs the steps designated by the reference signs S21 to S30 in FIG. 7 and the steps designated by the reference signs S31 to S45 in FIG. 9.

When the control portion 400 starts the potential control sequence, in the same way as in the first embodiment, in order to use the developing device for the first time, the control portion 400 starts a toner install mode for replenishing toner from the developer replenishment container 46 to the developing container 40 (S21).

Then, the control portion 400 starts the rotation of the developing roller 4*a*, the screw 4*c*, and the agitating member 4*d*, and at the same time, based on the result of the toner remaining amount detection element 4*e*, the control portion 400 intermittently replenishes toner from the developer replenishment container 46 to the vacant developing container 40 (S22). Further, at the same time of starting the rotation of the developing roller 4*a*, the control portion 400 starts the measurement of a cumulative number "n" of revolutions of the developing roller 4*a*, and the control portion 400 stores the measured number "n" of revolutions in the NVRAM 120 (S23).

Then, the control portion 400 applies a charging bias to the charging roller and applies a direct current bias of the developing biases to the developing roller (S24) so that the developing electric field Vcont2 is created. Then, the control portion 400 starts a charging bias varying sequence (S25). Here, the developing direct current bias (direct current bias of the developing biases) to be applied to the developing roller is fixed, and only the charging bias to be applied to the charging roller 2*a* is varied every predetermined cumulative number of revolutions, based on the measured value of the cumulative number "n" of revolutions of the developing roller 4*a*.

Figure 8A:
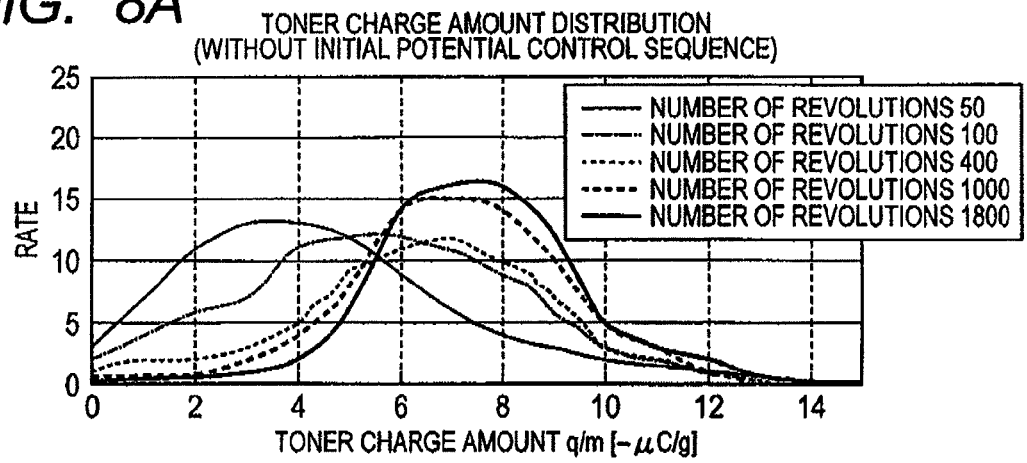
FIG. 8A is a graph showing a relationship between the number of revolutions of a developing roller and the toner charge amount distribution when the potential control is not performed.
Figure 8B:
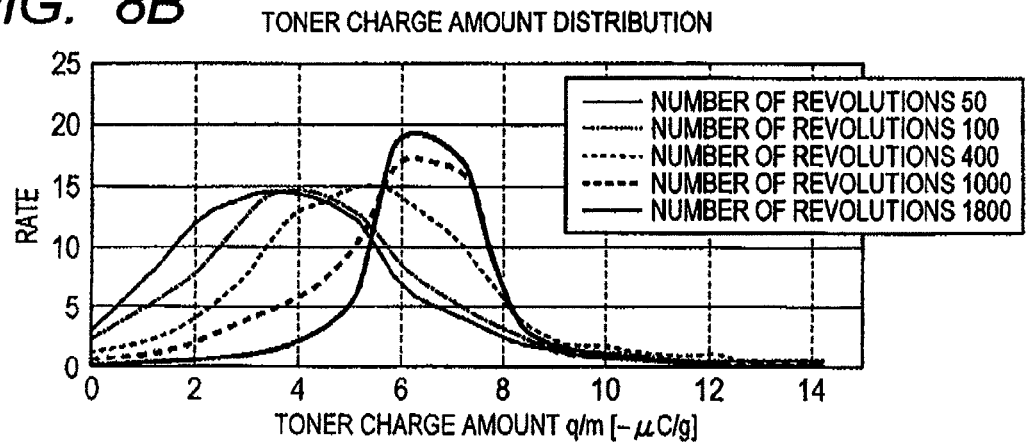
FIG. 8B is a graph showing a relationship between the number of revolutions of the developing roller and the toner charge amount distribution at a time of setting a developing device according the second embodiment.
Figure 8C:
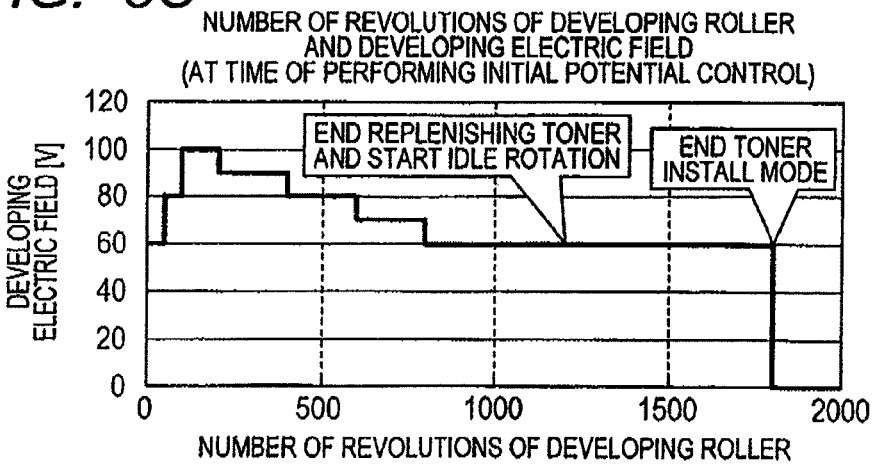
FIG. 8C is a graph showing a relationship between the number of revolutions of the developing roller and a potential difference in the potential control at a time of setting the developing device according to the second embodiment.

FIG. 8A shows a relationship between the number of revolutions of the developing roller and a toner charge amount distribution without the potential control. FIG. 8B shows a relationship between the number of revolutions of the developing roller and the toner charge amount distribution with the potential control. Further, FIG. 8C shows a relationship between the number of revolutions of a developing roller and the developing electric field Vcont2 at a time of performing the potential control sequence.

As shown in FIG. 8A, the charge amount of toner has a low stable charge amount distribution at the initial period of revolutions of the developing roller (cumulative number of revolutions: 50). However, when the cumulative number of revolutions of the developing roller increases, and as the rotation of the developing roller enters the intermediate period (cumulative number of revolutions: 100 and 400) and further enters the later period cumulative number of revolutions: 1,000 and 1,800), the charge amount of toner increases to have a wide charge amount distribution. That is, it is understood that, when the cumulative number of revolutions of the developing roller increases, the charge amount of toner increases to have a wide charge amount distribution, and hence the electrostatic aggregation of toner having an excessive charge amount exceeding an appropriate range (predetermined value range centered on the peak value) and toner having a small charge amount is likely to occur.

Therefore, the charging bias varying sequence is performed so as to transfer the toner having an excessive charge amount shown in FIG. 8A from the developing roller 4*a* onto the photosensitive member 1. Specifically, every time the above-mentioned cumulative number "n" of revolutions of the developing, roller 4*a* reaches a predetermined cumulative number of revolutions, the developing electric field Vcont2 is set for allowing the photosensitive member 1 to carry the toner having charge larger by a predetermined value than the peak value of the charge amount of the toner on the developing roller 4*a*.

The charge amount distribution is low and stable in the initial period of the rotation of the developing roller, and hence the developing electric field Vcont221 may be small. When the cumulative number of revolutions of the developing roller increases, the charge amount of toner increases to have a wide distribution, and the amount of toner that causes the electrostatic aggregation increases. Therefore, the developing electric field Vcont222 in the intermediate period is set to be larger than the developing electric field Vcont221 in the initial period. Thus, the toner having an excessive charge amount that causes the electrostatic aggregation is transferred from the developing roller onto the photosensitive member. Then, when the number of revolutions of the developing roller increases further, the charge amount of toner has a high and stable charge amount distribution, and the amount of toner that causes the electrostatic aggregation decreases. Therefore, the developing electric field Vcont223 in the later period is set to be smaller than the developing electric field VCont222 in the intermediate period. Here, regarding the charging bias and the developing bias to be applied, the developing electric field Vcont2 is regulated by varying only the charging bias in the same way as in the first embodiment.

Figure 9:
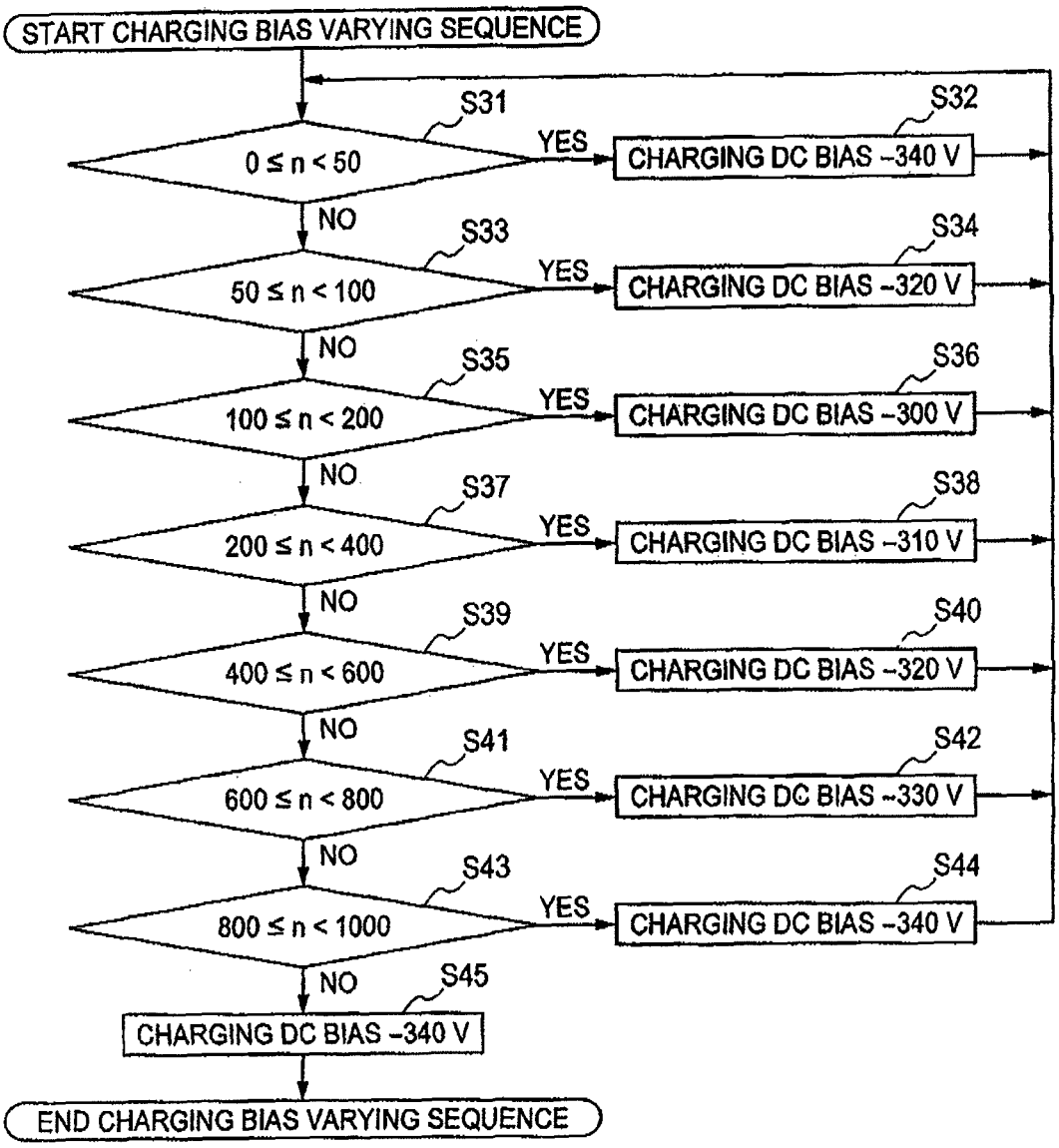
FIG. 9 is a flowchart illustrating a charging bias varying sequence in the potential control at a time of setting the developing device according to the second embodiment.

FIG. 9 is a flowchart illustrating the charging bias varying sequence for varying a charging bias according to the cumulative number of revolutions of the developing roller. During the charging bias varying sequence, in the same way as in the first embodiment, the biases are applied by varying only the charging bias but not varying the developing direct current bias Vdc (−400 V).

When the control portion 400 determines that the cumulative number "n" of revolutions of the developing roller, for which the measurement is started in S23, is $0 \leq n < 50$ (YES in S31), the control portion 400 applies a charging bias of −340 V to the charging roller (S32). Thus, the developing electric field Vcont2 becomes 60 V that is smaller than the developing electric field Vcont1 (700 V) during the image forming operation. This developing electric field Vcont2 enables the toner having an excessive charge amount (toner having a charge "q" of 9.0 or more) to be carried onto the photosensitive member from the developing roller.

When the control portion 400 determines that the cumulative number "n" of revolutions of the developing roller is 50≤n<100 (YES in S33), the control portion 400 applies a charging bias of −320 V to the charging roller (S34). Thus, the developing electric field Vcont2 becomes 0.80 V that is smaller than the developing electric field Vcont1 (700 V) during the image forming operation. This developing electric field Vcont2 enables the toner having an excessive charge amount (toner having a charge "q" of 8.0 or more) to be carried onto the photosensitive member from the developing roller.

When the control portion 400 determines that the cumulative number "n" of revolutions of the developing roller is 100≤n<200 (YES in S35), the control portion 400 applies a charging bias of −300 V to the charging roller (S36). Thus, the developing electric field Vcont2 becomes 100 V that is smaller than the developing electric field Vcont1 (700 V) during the image forming operation. This developing electric field Vcont2 enables the toner having an excessive charge amount (toner having a charge "q" of 7.0 or more) to be carried onto the photosensitive member from the developing roller.

When the control portion 400 determines that the cumulative number "n" of revolutions of the developing roller is 200≤n<400 (YES in S37), the control, portion 400 applies a charging bias of −310 V to the charging roller (S38). Thus, the developing electric field Vcont2 becomes 90 V that is smaller than the developing electric field. Vcont1 (700 V) during the image forming operation. This developing electric field Vcont2 enables the toner having an excessive charge amount (toner having a charge "q" of 7.5 or more) to be carried onto the photosensitive member from the developing roller.

When the control portion 400 determines that the cumulative number "n" of revolutions of the developing roller is 400≤n<600 (YES in S39), the control portion 400 applies a charging bias of −320 V to the charging roller (S40). Thus, the developing electric field Vcont2 becomes 80 V that is smaller than the developing electric field Vcont1 (700 V) during the image forming operation. This developing electric field Vcont2 enables the toner having an excessive charge amount (toner having a charge "q" of 8.0 or more) to be carried onto the photosensitive member from the developing roller.

When the control portion 400 determines that the cumulative number "n" of revolutions of the developing roller is 600≤n<800 (YES in S41), the control portion 400 applies a charging bias of −330 V to the charging roller (S42). Thus, the developing electric field Vcont2 becomes 70 V that is smaller than the developing electric field Vcont1 (700 V) during the image forming operation. This developing electric field Vcont2 enables the toner having an excessive charge amount (toner having a charge "q" of 8.5 or more) to be carried onto the photosensitive member from the developing roller.

When the control portion 400 determines that the cumulative number "n" of revolutions of the developing roller is 800≤n<1000 (YES in S43), the control portion 400 applies a charging bias of −340 V to the charging roller (S44). Thus, the developing electric field Vcont2 becomes 60 V that is smaller than the developing electric field Vcont1 (700 V) during the image forming operation. This developing electric field Vcont2 enables the toner having an excessive charge amount (toner having a charge "q" of 9.0 or more) to be carried onto the photosensitive member from the developing roller.

When the control portion 400 determines that the cumulative number "n" of revolutions of the developing roller is 1000≤n, the control portion 400 applies a charging bias of −340 V to the charging roller until the replenishment of toner is ended (S45). Thus, the developing electric field Vcont2 becomes 60 V that is smaller than the developing electric field Vcont1 (700 V) during the image forming operation, and the charging bias varying sequence is ended. This developing electric field Vcont2 enables the toner having an excessive charge amount (toner having a charge "q" of 9.0 or more) to be carried onto the photosensitive member from the developing roller.

As described above, by adjusting the developing electric field Vcont2 every time the cumulative number "n" of revolutions of the developing roller reaches predetermined cumulative number of revolutions, only the toner having a high charge amount (toner having an excessive charge amount) on the developing roller 4*a* is transferred onto the entire developing region of the photosensitive member 1, and collected by the cleaning device 6. Thus, the toner having a charge amount within an appropriate range (within a predetermined value range centered on the peak value) remains on the developing roller 4*a*. This can reduce the electrostatic aggregation of the toner having an excessive charge amount and the toner having a small charge amount, and reduce the occurrence of a defective image such as flecks and streaks in the rotation period of the developing roller caused by the electrostatic aggregation.

Figure 7:
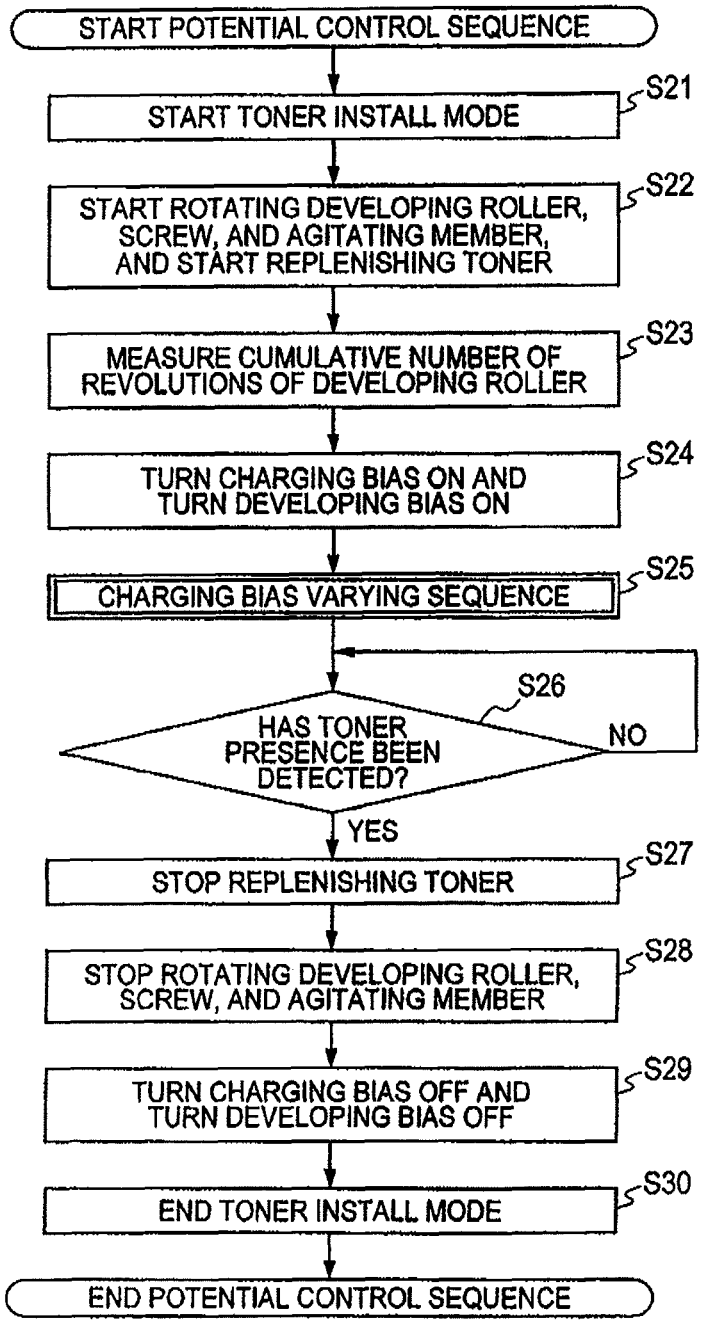
FIG. 7 is a flowchart illustrating a potential control sequence according to the second embodiment.

In FIG. 7, when the control portion 400 determines that the toner remaining amount detection element 4*e* has detected the "toner presence" (S26), the control portion 400 stops the replenishment of toner (S27). After the stop of the replenishment of toner, the control portion 400 stops the rotation of the developing roller 4*a*, the screw 4*c*, and the agitating member 4*d* (S28), and the control portion 400 ends the application of the charging bias and the developing bias (S29). Then, the control portion 400 ends the toner install mode (S30), and the potential control sequence is ended.

The developing electric field Vcont2 created by the potential control is always the same in the first embodiment, whereas the developing electric field Vcont2 (here, each of Vcont21, 22, and 23) is varied every cumulative number "n" of revolutions of the developing roller in this embodiment. Therefore, the toner having an excessive charge amount can be transferred selectively from the developing roller onto the photosensitive member with higher accuracy. This enables the toner whose charge amount is becoming excessive to be transferred onto the photosensitive member 1 with higher accuracy, to thereby reduce the electrostatic aggregation further.

(Third Embodiment)

An image forming apparatus according to a third embodiment will be described. In this embodiment, the developing electric field Vcont2 is adjusted according to the detection result of the toner remaining amount detection element 4*e* in the developing container 40. The other configuration is the same as that of the above-mentioned first embodiment. Therefore, members having the same functions as those of the members therein are designated by the same reference numerals, and description thereof is omitted.

In this embodiment, the toner remaining amount detection element 4*e* detects the presence/absence of toner. In a case of "out of toner (toner absence)", the developer replenishment container 46 replenishes toner to the developing container 40.

In the control portion 300 illustrated in FIG. 1, the toner remaining amount detection element 4*e* detects toner in the developing container 40 every predetermined time. Then, the control portion 300 integrates the detections of toner for the predetermined time, that is, the control portion 300 determines that the "toner presence (developer presence)" has been detected when the toner remaining amount detection element 4*e* detects ("ON") toner a predetermined number of times or more during one, period (for example, one revolution of the agitating member), and determines that the "out of toner" has been detected when the toner remaining amount detection element 4*e* does not detect ("ON") toner a predetermined number of times or more during one period.

The toner in the developing container is agitated constantly by the agitating member 4*d*. Therefore, as the amount of the toner in the developing container is larger, the number of detections of toner every one period increases. For example, in a case of using a toner remaining amount detection element that detects the presence/absence of toner every 0.05 second, assuming that two seconds correspond to one period, 40 times of detections can be performed. Here, a case where the toner remaining amount detection element 4*e* detects toner is defined as "ON", and a case where the toner remaining amount detection element 4*e* does not detect toner is defined as "OFF". When the number of times of "ON" in which toner has been detected is 10 or more out of the 40 times, the control portion 300 determines that the "toner presence" has been detected, and when the number of times of "ON" is less than 10, the control portion 300 determines that the "out of toner" has been detected.

Figure 11A:
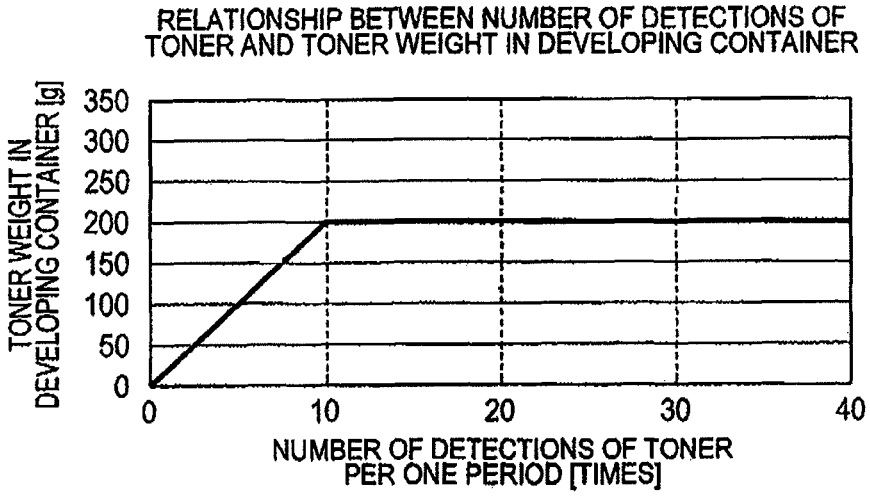
FIG. 11A is a graph showing a toner weight in a developing container and a result of detections of toner according to the third embodiment.

FIG. 11A shows a relationship between the result of the detections of toner presence/absence and the toner weight in the developing container. In this embodiment, as shown in FIG. 11A, the toner weight in the developing container when the "toner presence" has been detected is 200 g, which is also an appropriate toner weight in the developing container in the developing device of this embodiment.

Next, initial potential control in the image forming apparatus according to this embodiment will be described. The potential control sequence according to this embodiment is performed for control in accordance with the flowcharts of FIGS. 10 and 12. The control portion 300 performs the steps designated by the reference signs S51 to S60 in FIG. 10 and the steps designated by the reference signs S61 to S75 in FIG. 12.

When the control portion 300 starts the potential control sequence, in the same way as in the first embodiment, in order to use the developing device for the first time, the control portion 300 starts a toner install mode for replenishing toner from the developer replenishment container to the developing container 40 (S51).

Then, the control portion 300 starts the rotation of the developing roller 4*a*, the screw 4*c*, and the agitating member 4*d*, and at the same time, based on the result of the toner remaining amount detection element 4*e*, the control portion 300 intermittently replenishes toner from the developer replenishment container 46 to the vacant developing container 40 (S52). Further, the Control portion 300 counts the number of detections of toner every predetermined time, using the toner remaining amount detection element 4*e* (S53). The number "n" of detections of toner every predetermined time is the number of times at which the toner remaining amount detection element 4*e* is turned "ON" every predetermined time.

Then, the control portion 300 starts applies a charging bias to the charging roller and applies a direct current bias of the developing biases to the developing roller (S54) so that a developing electric field Vcont2 is created. Then; the control portion 300 starts a charging bias varying sequence (S55). Here, the developing direct current bias (direct current bias of the developing biases) to be applied to the developing roller is fixed, and only the charging bias to be applied to the charging roller is varied every predetermined number of detections, based on the above-mentioned number of detections of toner.

In this embodiment, the control portion 300 changes the developing electric field Vcont2 in the potential control sequence so as to increase in stages, every time the number "n" of detections of toner every predetermined time by the toner remaining amount detection element 4*e* in the setting sequence reaches a predetermined number. Here, the toner is successively replenished to the developing device at a time of setting the developing device to be used for the first time, and the developing electric field Vcont2 is adjusted, with a period being divided into an initial period, an intermediate period, and a later period, until the replenishment is ended.

Specifically, the developing electric field Vcont2 in the initial period of the number "n" of detections of toner is designated by Vcont231, the developing electric field Vcont2 in the intermediate period of the number of detections of toner is designated by Vcont232, and the developing electric field Vcont2 in the later period of the number of detections of toner is designated by Vcont233. The control portion 300 controls a bias to be applied to the charging roller and a bias to be applied to the developing roller so that those developing electric fields Vcont2 satisfy the following relationships under the condition that the developing electric fields Vcont2 satisfy the above-mentioned relationships of the first embodiment:

$$V\text{cont1} > V\text{cont232} \geq V\text{cont231}$$

$$V\text{cont1} > V\text{cont232} \geq V\text{cont233}$$

When the toner weight in the developing container is small, the developing roller is in an initial rotation period. Therefore, in the same way as in the above-mentioned embodiments, the charge amount of the toner on the developing roller 4*a* is not stable, and the toner having an excessive charge amount and the toner having a small charge amount are mixed, and the electrostatic aggregation is likely to occur.

Figure 11B:
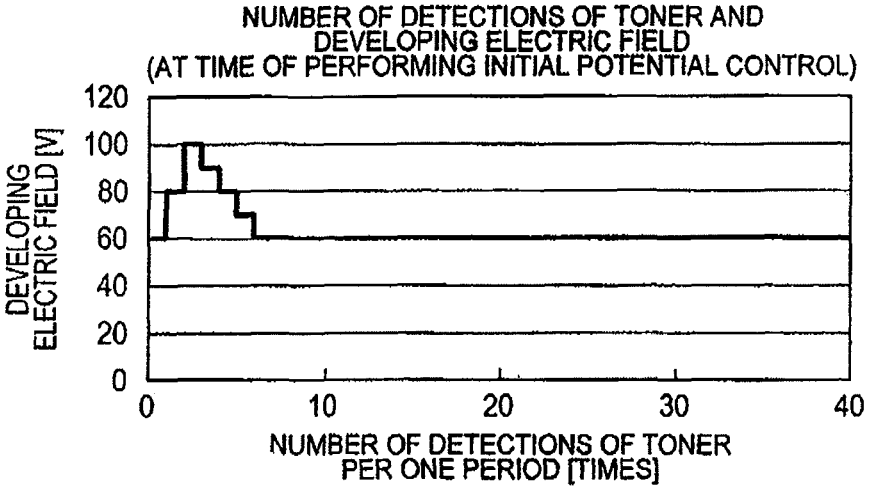
FIG. 11B is a graph showing a relationship between the result of detections of a toner remaining amount detection element and a development start potential difference according to the third embodiment.

Therefore, the charging bias varying sequence is performed so as to transfer the toner having an excessive charge amount (toner having a high charge amount having charge larger by a predetermined value than the peak value) from the developing roller 4*a* onto the photosensitive member 1. Specifically, as shown in a relationship between the result of the detection of the toner remaining amount detection element and the development start potential difference in FIG. 11B, every time the number "n" of detections of the toner presence "ON" every predetermined time (here, every one period) by the toner remaining amount detection, element 4*e* reaches a predetermined number, the developing electric field Vcont2 is set for allowing the photosensitive member 1 to carry the toner having charge that is larger by a predetermined value than the peak value of the charge amount of the toner on the developing roller 4*a*. Here, regarding the charging bias and the developing bias to be applied, the developing electric field Vcont2 is adjusted by varying only the charging bias in the same way as in the first embodiment.

Figure 12:
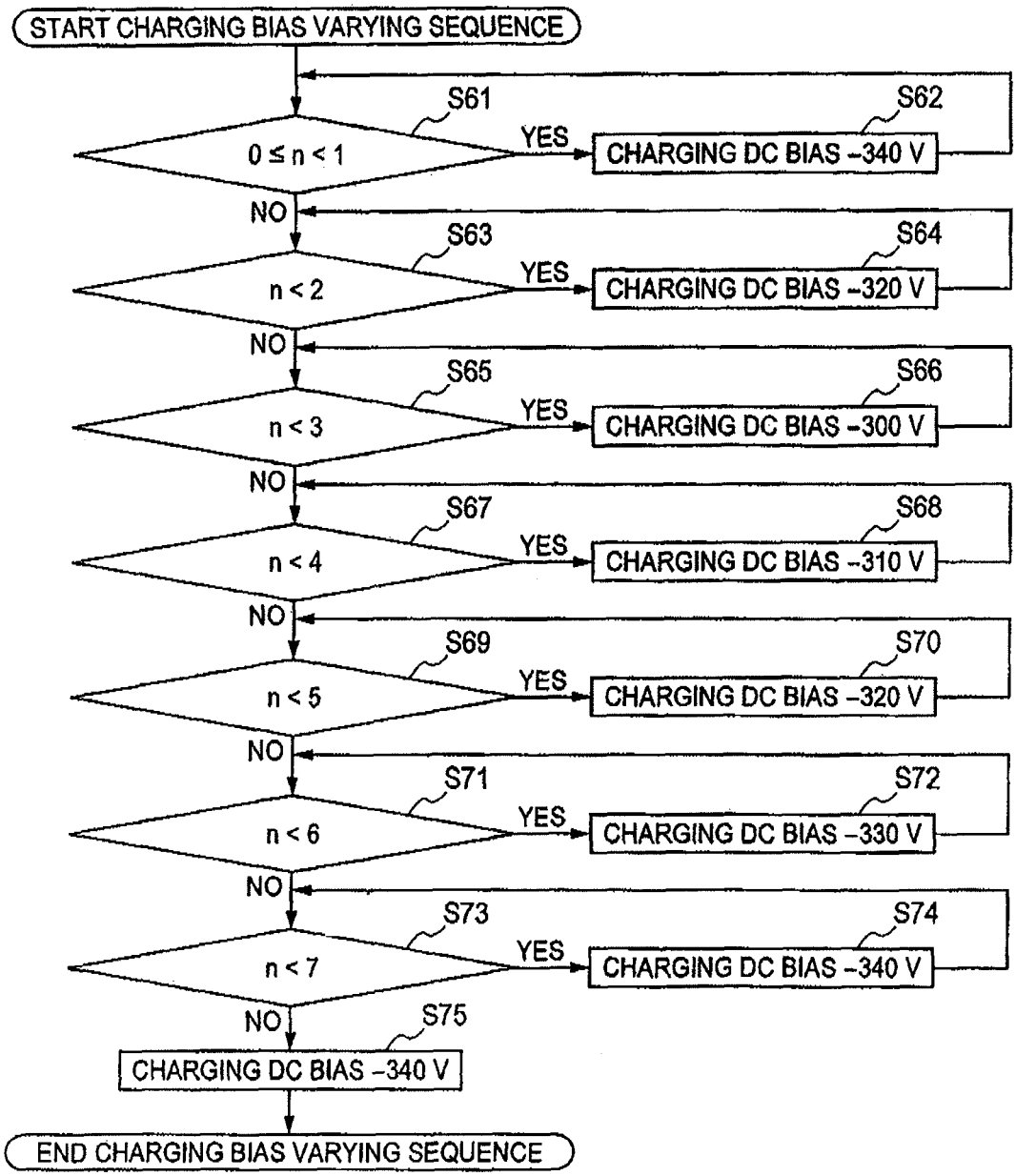
FIG. 12 is a flowchart illustrating a charging bias varying sequence in the potential control at a time of setting a developing device according to the third embodiment.

FIG. 12 is a flowchart of the charging bias varying sequence for varying a charging bias according to the number of detections of toner using the toner remaining amount detection element 4*e*. During the charging bias varying sequence, in the same way as in the first embodiment, the biases are applied by varying only the charging bias but not varying the developing direct current bias Vdc (−400 V).

When the control portion 300 determines that the number "n" of detections of toner every predetermined time in S53 satisfies 0≤n<1 (YES in S61), the control portion 300 applies a charging bias of −340 to the charging roller (S62). Thus, the developing electric field Vcont2 becomes 60 V that is smaller than the developing electric field Vcont1 (700 V) during the image forming operation. This developing electric field Vcont2 enables the toner having an excessive charge amount (toner having a charge "q" of 9.0 or more) to be carried onto the photosensitive member from the developing roller.

When the control portion 300 determines that the number "n" of detections of toner is n<2 (YES in S63), the control portion 300 applies a charging bias of −320 V to the charging roller (S64). Thus, the developing electric field Vcont2 becomes 80 V that is smaller than the developing electric field Vcont1 (700 V) during the image forming operation. This developing electric field Vcont2 enables the toner having an excessive charge amount (toner having a charge "q" of 8.0 or more) to be carried onto the photosensitive member from the developing roller.

When the control portion 300 determines that the number "n" of detections of toner is n<3 (YES in S65), the control portion 300 applies a charging bias of −300 V to the charging roller (S66). Thus, the developing electric field Vcont2 becomes 100 V that is smaller than the developing electric field Vcont1 (700 V) during the image forming operation. This developing electric field Vcont2 enables the toner having an excessive charge amount (toner having a charge "q" of 7.0 or more) to be carried onto the photosensitive member from the developing roller.

When the control portion 300 determines that the number "n" of detections of toner is n<4 (YES in S67), the control portion 300 applies a charging bias of −310 V to the charging roller (S68). Thus, the developing electric field Vcont2 becomes 90 V that is smaller than the developing electric field Vcont1 (700 V) during the image forming operation. This developing electric field Vcont2 enables the toner having an excessive charge amount (toner having a charge "q" of 7.5 or more) to be carried onto the photosensitive member from the developing roller.

When the control portion 300 determines that the number "n" of detections of toner is n<5 (YES in S69), the control portion 300 applies a charging bias of −320 V to the charging roller (S70). Thus, the developing electric field Vcont2 becomes 80 V that is smaller than the developing electric field Vcont1 (700 V) during the image forming operation. This developing electric field Vcont2 enables the toner having an excessive charge amount (toner having a charge "q" of 80 or more) to be carried onto the photosensitive member from the developing roller.

When the control portion 300 determines that the number "n" of detections of toner is n<6 (YES in S71), the control portion 300 applies a charging bias of −330 V the charging roller (S72). Thus, the developing electric field Vcont2 becomes 70 V that is smaller than the developing electric field Vcont1 (700 V) during the image forming operation. This developing electric field Vcont2 enables the toner having an excessive charge amount (toner having a charge "q" of 8.5 or more) to be carried onto the photosensitive member from the developing roller.

When the control portion 300 determines that the number "n" of detections of toner is n<7 (YES in S73), the control portion 300 applies a charging bias of −340 V to the charging roller (S74). Thus, the developing-electric field Vcont2 becomes 60 V that is smaller than the developing electric field Vcont1 (700 V) during the image forming operation. This developing electric field Vcont2 enables the toner having an excessive charge amount (toner having a charge "g" of 9.0 or more) to be carried onto the photosensitive member from the developing roller.

When the control portion 300 determines that the number "n" of detections of toner is 7≤n, the control portion 300 applies a charging bias of −340 V to the charging roller until the replenishment of toner is ended (S75). Thus, the developing electric field Vcont2 becomes 60 V that is smaller than the developing electric field Vcont1 (700 V) during the image forming operation, and the charging bias varying sequence is ended. This developing electric field Vcont2 enables the toner having an excessive charge amount (toner having a charge "q" of 9.0 or more) to be carried onto the photosensitive member from the developing roller.

As described above, by adjusting the developing electric field Vcont2 every time the number "n" of detections of toner reaches a predetermined number of detections, only the toner having a high charge amount (toner having an excessive charge amount) on the developing roller 4*a* is transferred onto the entire developing region of the photosensitive member 1, and collected by the cleaning device 6. Thus, the toner having a charge amount within an appropriate range (within a predetermined value range centered on the peak value) remains on the developing roller 4*a*. This can reduce the electrostatic aggregation of the toner having an excessive charge amount and the toner having a small charge amount, and reduce the occurrence of a defective image such as flecks and streaks in the rotation period of the developing roller caused by the electrostatic aggregation.

Figure 10:
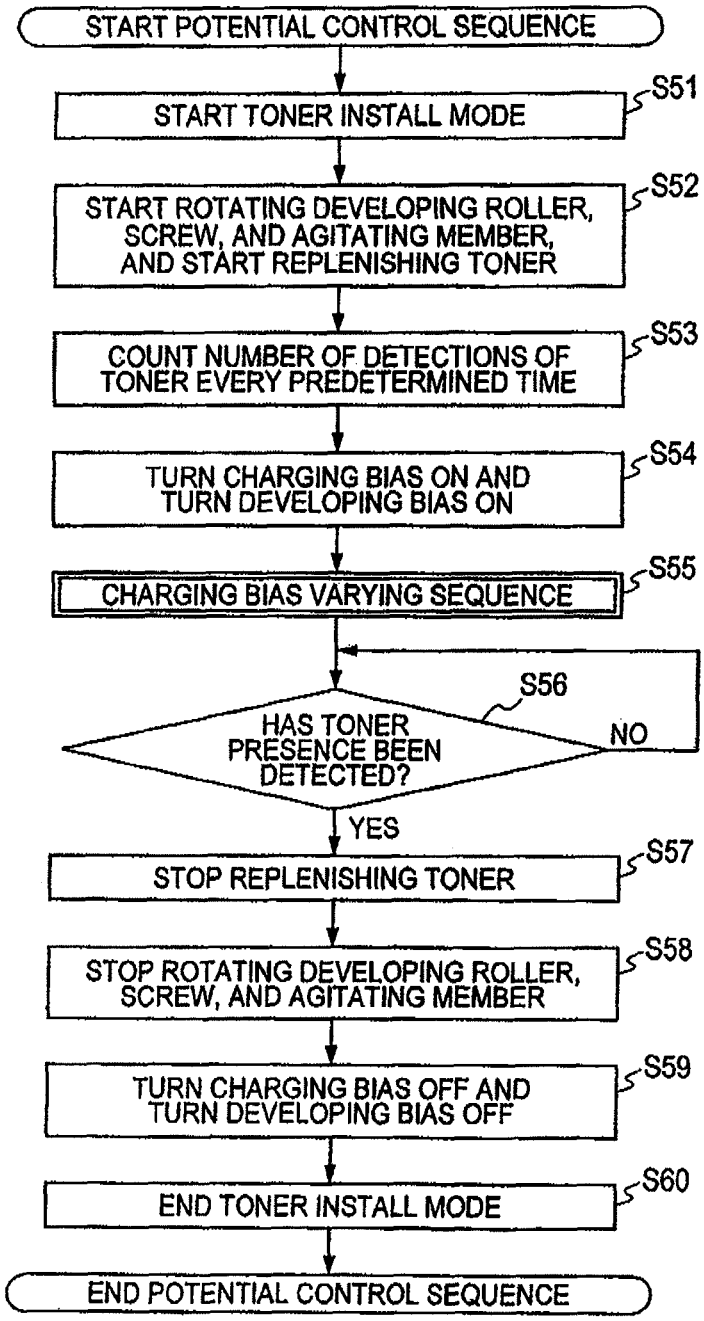
FIG. 10 is a flowchart illustrating a potential control sequence according to a third embodiment.

In FIG. 10, when the toner remaining amount detection element 4*e* has detected the "toner presence" (S56), the replenishment of toner is stopped (S57). Note that, the toner remaining amount detection element 4*e* detects the "toner presence" when the number of detections of toner every 40 times (number of times of "ON") is 10 out of 40 or more. After the stop of the replenishment of toner, the rotation of the developing roller 4*a*, the screw 4*c*, and the agitating member 4*d* is stopped (S58), and the application of the charging bias and the developing bias is ended (S59). Then, the toner install mode is ended (S60), and the potential control sequence is ended.

The developing electric field Vcont2 created by the potential control is always the same in the first embodiment, whereas the developing electric field Vcont2 is varied every number "n" of detections of toner by the toner remaining amount detection element in this embodiment. Therefore, the toner having an excessive charge amount can be transferred selectively from the developing roller onto the photosensitive member with higher accuracy. This enables the toner whose charge amount is becoming excessive to be developed onto the photosensitive member 1 with higher accuracy, to thereby reduce the electrostatic aggregation further.

(Fourth Embodiment)

Figure 13A:
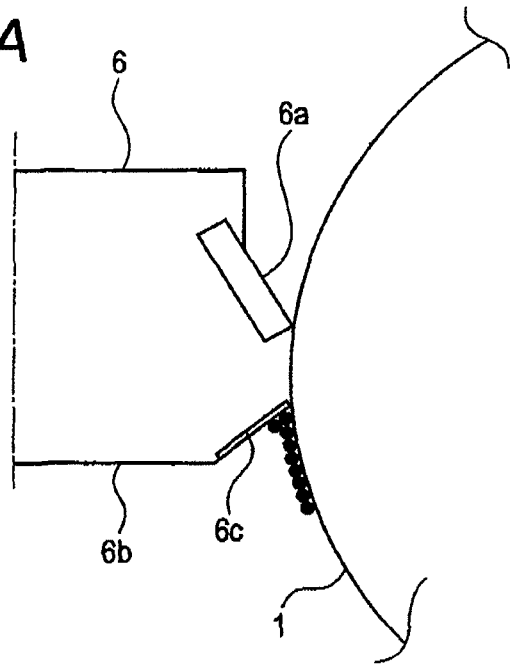
FIGS. 13A and 13B are enlargement views illustrating a relevant part of a photosensitive member and a cleaning device at a time of a potential control sequence according to a fourth embodiment.
Figure 13B:
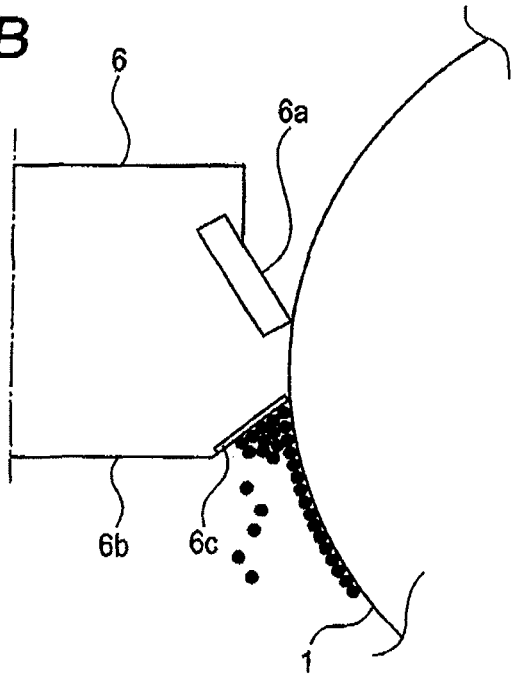

A fourth embodiment will be described with reference to FIGS. 13A and 13B. FIGS. 13A and 13B are views illustrating a photosensitive member and a cleaning device at a time of a potential control sequence. FIGS. 13A and 13B illustrate the photosensitive member 1, the cleaning device 6, the cleaning blade 6*a*, and the cleaning container 6*b*.

In this embodiment, the control portion 300 controls an application timing of ON/OFF of biases to be applied to the charging roller and the developing roller at the time of the potential control sequence in order to remove toner having an excessive charge amount more suitably in addition to the above-mentioned embodiments.

As described above, at the time of the potential control sequence, the toner having an excessive charge amount is supplied to the photosensitive member 1 by applying biases to the charging roller and the developing roller. The toner supplied to the photosensitive member 1 is collected by the cleaning device. At this time, the toner supplied to the photosensitive member 1 slips through the scooping sheet 66 of cleaning device 6 that is in contact with the photosensitive member 1, so as to reach the cleaning blade. However, when the biases continue to be applied to the charging roller and the developing roller, a part of the toner supplied to the photosensitive member 1 may be unable to slip through the scooping sheet 6*c*, and stopped by the scooping sheet 6*c* before reaching the cleaning blade 6*a*, as illustrated in FIG. 13A. In this case, the photosensitive member 1 continues to the carry toner to some degree, and hence, the toner is not dropped inside the apparatus. However, when the biases continues to be applied to the charging roller and the developing roller, the amount of the toner stopped by the scooping sheet 6*c* increases to such a degree that the photosensitive member can no longer carry, and may be dropped inside the apparatus, as illustrated in FIG. 13B.

Therefore, in this embodiment, the control portion 300 repeats ON/OFF of the biases to be applied to the charging roller and the developing roller at the time of the potential control sequence so as to apply the biases for a period of time corresponding to at least one revolution or more of the developing roller when the biases are ON.

The timing of ON/OFF of the biases by the control portion 300 may be varied depending upon the design such as characteristics of the toner. For example, toner whose charge amount tends to rise is likely to generate toner having an excessive charge amount. Therefore, control is performed so that the biases are repeatedly turned ON during 5 revolutions of the developing roller, turned OFF during the subsequent two revolutions, turned ON during the subsequent 5 revolutions, and turned OFF during the subsequent two revolutions. By turning OFF the biases intermittently in this manner, a timing at which the toner stopped by the scooping sheet 6*c* is collected into the cleaning device can be taken, which can prevent the amount of the stopped toner from increasing successively so that the toner is dropped inside the apparatus.

As described above, the potential control sequence is performed by switching the timing of ON/OFF of the charging bias and the developing bias depending on the characteristics of the toner. Thus, toner on the photosensitive member can be collected by the cleaning device without being dropped inside the apparatus at the time of the potential control sequence, and unnecessary toner having an excessive charge amount can be removed more effectively.

(Fifth Embodiment)

Figure 14:
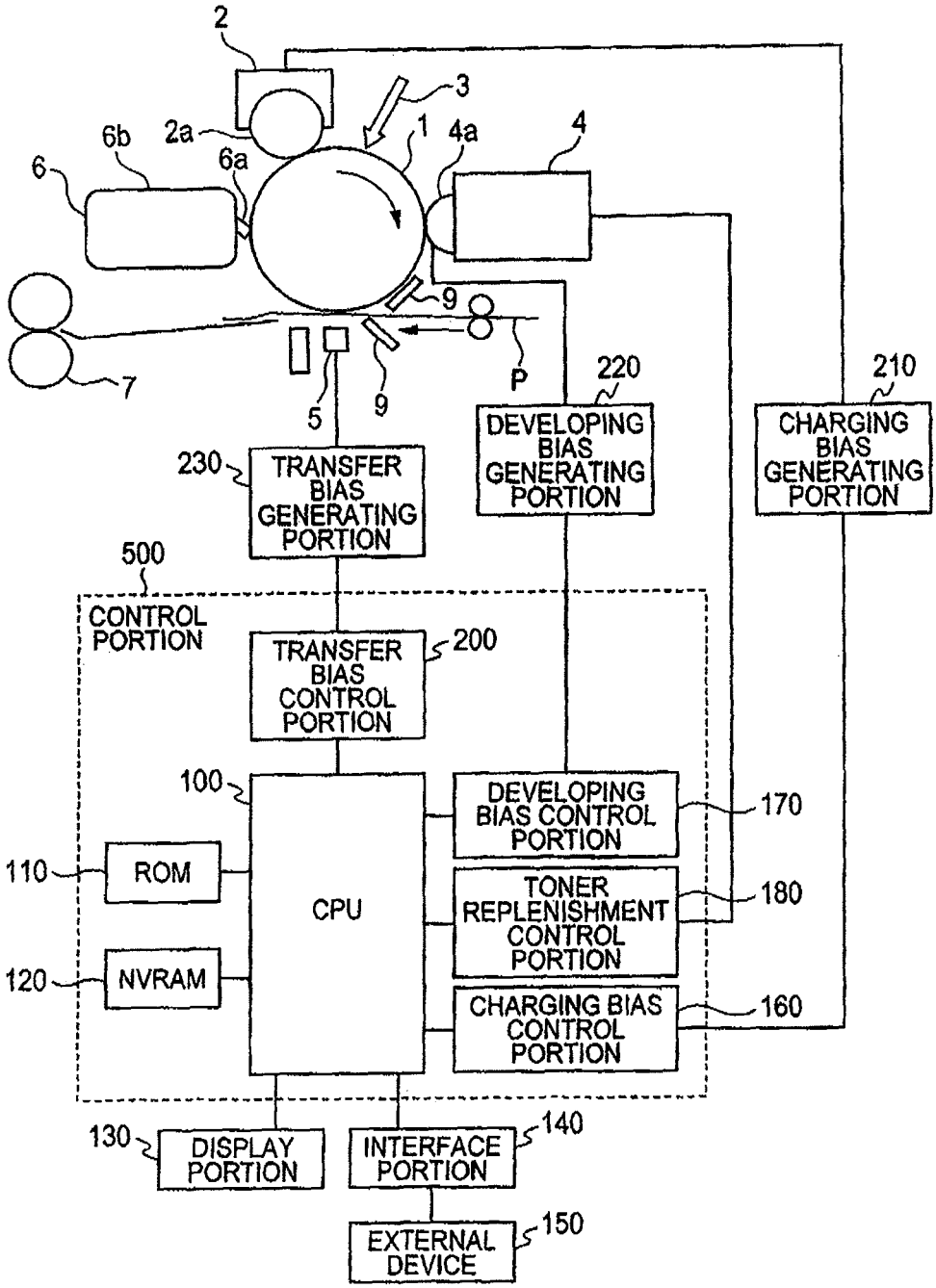
FIG. 14 is an explanatory schematic view illustrating an image forming apparatus according to a fifth embodiment.

Next, a fifth embodiment will be described with reference to FIG. 14. FIG. 14 is an explanatory schematic view illustrating an image forming apparatus according to the fifth embodiment.

In this embodiment, in order to realize the above-mentioned embodiments more suitably, a control potion (control unit) 500 performs control so that a cleaning bias is applied to the transfer device 5 at a time of a potential control sequence. As illustrated in FIG. 14, the control portion 500 includes the transfer bias control portion 200 for the transfer device 5 and controls a transfer bias to be applied to the transfer device 5 via a transfer bias generating portion 230, in the same way as in the charging roller 2*a* and the developing roller 4*a*.

For example, in a case of negatively charged toner, the toner on the photosensitive member 1 is transferred onto a sheet by applying a positive direct current bias serving as a transfer bias to the transfer device 5 at a time of an ordinary image formation. However, during the potential control sequence in which a sheet is not conveyed, when the toner on the photosensitive member 1 reaches a transfer region opposed to the transfer device 5, the toner may adhere to the transfer device 5 to contaminate the transfer device 5.

Therefore, the toner on the photosensitive member 1 is prevented from adhering to the transfer device 5 by applying, during the potential control sequence, a transfer bias (cleaning bias) with a polarity opposite to that of a direct current bias at a time of the image formation to the transfer device 5.

In this embodiment, at the time of the ordinary image formation, the control portion 500 applies a positive direct current bias of +4 kV as a transfer bias to the transfer device 5. Further, the control portion 500 applies a negative direct current bias of −2 kV as a cleaning bias, which has a polarity opposite to that at a time of the image formation, to the transfer device 5 at the time of non-passage of a sheet, such as inter-sheet spacing (between sheets) and operations before or after the image formation. This can prevent the negatively charged toner on the photosensitive member 1 from adhering to the transfer device 5.

However, when a negative direct current bias of −2 kV continues to be applied so as to clean the transfer device 5 as described above even during the potential control sequence, a memory in which charge remains on the photosensitive member 1 may be generated to cause density unevenness at the time of the image formation.

Therefore, in this embodiment, the toner on the photosensitive member 1 is only the negatively charged toner having an excessive charge amount. Therefore, considering that it is possible to clean the transfer device 5 sufficiently even with a weak negative direct current cleaning bias, the control portion 500 applies a negative direct current bias (cleaning bias) smaller than that at the time of non-passage of a sheet to the transfer device 5 during the potential control sequence. Specifically, during the potential control sequence, the control portion 500 applies a negative direct current bias of −1 kV to the transfer device 5 as a cleaning bias. This can prevent a memory in which charge remains on the photosensitive member 1 and prevent the toner on the photosensitive member 1, from adhering to the transfer device 5.

Further, in order to realize the above-mentioned embodiments more suitably, during the initial potential control sequence, the above-mentioned cleaning bias may also be applied to the transfer guide (transfer material guide member) 9 that guides a sheet that is a transfer material to a nip portion between the photosensitive member 1 and the transfer device 5.

The transfer guide 9 is formed of a conductive member and is provided in the vicinity of the nip portion so as to convey the transfer material to the nip portion between the photosensitive member 1 and the transfer device 5. Therefore, during the potential control sequence, the toner on the photosensitive member 1 may adhere to the transfer guide 9 in the vicinity of the photosensitive member 1 to contaminate the transfer guide 9.

Therefore, during the potential control sequence, the control portion 500 applies a bias with the same polarity as that of the toner to the transfer guide 9. This can prevent the toner on the photosensitive member 1 from adhering to the transfer guide 9. For example, in this embodiment, the negatively charged toner on the photosensitive member 1 is prevented from adhering to the transfer guide 9 by applying a negative direct current bias of −2 kV to the transfer guide 9.

As a structure which applies a bias to the transfer guide 9, the transfer bias control portion and the transfer bias generating portion for the transfer device 5 described above may be used, or a structure separately provided for the transfer guide 9 may be used.

(Other Embodiment)

Further, in the above-mentioned embodiments, the reverse development (discharged area development) system for transferring developer onto an exposed portion of the photosensitive member is exemplified, but the present invention is not limited thereto and is also effective in the regular development (charged area development) of developing developer onto a non-exposed portion of the photosensitive member. In this case, the developing electric field Vcont1 at a time of the image forming operation and the developing electric field Vcont2 at a time of the potential control sequence are expressed by the following expressions.

$$Vcont1=|Vl|-(1/2)Vpp+|Vdc|$$

$$Vcont2=|Vset|-Vdc'|$$

Note that, the relationships of the developing electric fields Vcont1 and Vcont2 are the same as those of the above-mentioned embodiments.

In the embodiments so far, the embodiments of the invention is described with reference to the image forming apparatus, as an example, having a development method in which the developing bias to be applied to the developing roller 4*a* of the developing device 4 contains the direct current component and the alternate current component superimposed on each other.

As the present invention utilizes a development characteristic in which a charge amount of toner flying from the developing roller 4*a* to the photosensitive member 1 varies in accordance with the amount of the direct current component of the developing electric field between the developing roller 4*a* and the photosensitive member 1, there is no need to limit the invention to the developing bias containing the alternate current bias component at the time of the image formation. The invention may be applied to a developing device using a development method in which a development condition is satisfied by applying a direct current bias component to the developing bias at the time of the image formation.

In that case, if the control is performed in such a manner that the following expression is satisfied: Vcont1=|Vdc|−|Vl|, where Vcont1 represents a developing electric field for supplying the toner from the developing roller to the photosensitive member, Vdc represents a potential of the direct current component of the developing bias, and Vl represents a bright section potential of the photosensitive member charged by the charging device and exposed to light by the exposure device, and at a time of the potential control sequence, the bias of the direct current component is applied to the developing roller so that the following expressions are satisfied: Vcont2=|Vdc'|−|Vset|; and Vcont1>Vcont2>0, where Vcont2 represents a developing electric field for supplying the toner from the developing roller to the photosensitive member, Vdc' represents a potential of the direct current component, and Vset represents a potential of the photosensitive member charged by the charging device, the toner having an excessive charge amount can be removed by development (transfer of the toner having the excessive charge amount from the developing roller to the photosensitive member) so that the toner having the excessive charge amount which causes the electrostatic aggregation at the time of replenishment of the toner can be reduced.

Incidentally, in the embodiment, the potential control sequence is performed at the time of replenishment of developer performed at the installation of a developing device which is used for the first time. However, the invention is not limited to the developing device which is used for the first time. After the start of use of the developing device, in the case of replenishing the developing device, of which developer is consumed, with developer, the potential control sequence can be performed so that the developer having an excessive charge amount is transferred from the developer carrying member to the image bearing member so as to be removed from the developing device.

Further, the condition for performing the potential control sequence may be limited to a low-humidity environment in which the charge amount of toner is likely to become large. For example, an environment detection device (environment detection unit) which detects the temperature and humidity of an environment is used. As the humidity is lower, the charge amount peak of toner is more likely to become large and a defective image caused by the electrostatic aggregation occurs more easily. Therefore, when the detection result of the environment detection device is higher than a predetermined humidity, the potential control sequence may not be performed, and when the detection result of the environment detection device is lower than a predetermined humidity, the potential control sequence may be performed.

In the above-mentioned embodiments, non-contact corona discharge is exemplified as the transfer device, but the present invention is not limited thereto, and for example, a transfer roller of a contact type may be used.

Further, in the developer in the developing device immediately after installation, or in a little developer remaining in the developing device before a fresh developer is replenished, a developer having an insufficient amount of imparted charge of an electric polarity which the developer should intrinsically have, or a developer having an electric polarity opposite to the electric polarity which the developer should intrinsically have may exist. Such a developer having one different from the electric polarity which the developer should intrinsically have may cause a problem such as a so-called reverse fogging phenomenon in which a developer may be supplied to a non-image forming area to which the developer is not wanted to be supplied when developing a latent image on an image bearing member. The present embodiments are effectively used as means for removing such a developer different in electric polarity or a so-called reversely charged toner.

Further, as the image forming apparatus, an image forming apparatus such as a printer, a copier, or a facsimile machine, or an image forming apparatus such as a multifunctional peripheral having a combination of those functions may be used. In the case of replenishing toner to a developing device of those image forming apparatuses, the same effects can be obtained by carrying out the above-mentioned potential control sequence.

Furthermore, according to the embodiments, at the time of the developer install mode, a predetermined charge bias is applied to the charge roller as the charge device to charge the image bearing member to the desired surface potential Vset, and a developing direct current bias Vdc' is applied to the developer carrying member as the developing device to form the developing electric field Vcont2 for supplying the developer from the developer carrying member to the image bearing member. However, both of the charging bias and the developing bias may be but need not be applied. The application of one of the charging bias and the developing bias may form the developing electric field Vcont2.

For example, according to the first embodiment, the surface potential Vset of the image bearing member is charged at −320 V and the developing direct current bias Vdc' of −400 V is applied to form the developing electric field Vcont2 of 80 V.

However, in the case that the charging bias is turned off, that is, when the surface potential of the image bearing member is 0 V, in order to form the developing electric field Vcont2 of 80 V, the developing direct current bias Vdc' may be set, at −80 V to form the developing electric field Vcont2 of 80 V.

On the other hand, in the case that developing direct current bias is turned off, that is, when the developing bias Vdc' is 0 V, in order to form the developing electric field Vcont2 of 80 V, the charging direct current bias Vdc' of +100 V may be applied to the image bearing member to set the surface potential of the image bearing member at 80 V to form the developing electric field Vcont2 of 80 V.

The case in that the voltage Vdc of the direct current component of the bias to be applied to the developing device at the time of the image forming operation has the same value as the voltage Vdc' of the direct current component of the bias to be applied to the developing device at the time of the developer install mode is described above. However, the present invention is not limited thereto. The voltage Vdc may have a different value from the voltage Vdc'.

In this way, a bias is applied to one of the charging device and the developer carrying member to form the developing electric field Vcont2 to perform the potential control sequence. Therefore, the developer having an excessive charge amount can be supplied from the developer carrying member to the image bearing member so as to be removed from the developing device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-283799, filed Dec. 20, 2010 and No. 2011-249450, filed Nov. 15, 2011, which are hereby incorporated by reference herein in their entirety.

What is claimed is:

1. An image forming apparatus, comprising:

an image bearing member;

a charging device which charges the image bearing member to a predetermined potential uniformly;

an exposure device which exposes the charged image bearing member to light according to an image signal to form an electrostatic latent image on the image bearing member in accordance with an image;

a developing device including a developer carrying member having a bias containing at least a direct current component applied thereto to supply developer to the image bearing member, and developing the electrostatic latent image by supplying the developer from the developer carrying member;

an instructing portion which generates an instruction signal for instructing to perform a developer install mode for installing developer in the developing device at a time of non-image formation; and a control portion which adjusts a potential difference between the image bearing member and the developer carrying member in the developer install mode in response to the instruction signal from the instructing portion, wherein, in the developer install mode, the control portion sets an absolute value of a potential on the image bearing member charged by the charging device to a value which is smaller than an absolute value of a potential of the developer carrying member caused by the direct current component of the bias to be applied to the developing device and larger than an absolute value of an image dark section potential on the image bearing member at the time of image formation.

2. An image forming apparatus according to claim 1, further comprising a cleaning device including a cleaning member which removes the developer remaining on the image bearing member and a collecting member which collects the developer removed by the cleaning member, the cleaning device collecting the developer supplied to the image bearing member at the time of the developer install mode, wherein the control portion repeats ON/OFF of the bias to be applied to one or both of the charging device and the developer carrying member at the time of the developer install mode and applies the bias for a period of time corresponding to at least one revolution of the developer carrying member when the bias in ON.

3. An image forming apparatus according to claim 1, further comprising a transfer device provided opposite to the image bearing member, the transfer device having a bias applied thereto to transfer the developer developed on the image bearing member to a transfer material, wherein the control portion controls a bias to be applied to the transfer device and applies a bias having a polarity opposite to a polarity at a time of image formation to the transfer device during the developer install mode.

4. An image forming apparatus according to claim 3, further comprising a conductive transfer material guide member which guides the transfer material to between the image bearing member and the transfer device, wherein the control portion applies the bias having the polarity opposite to the polarity at the time of the image formation to the conductive transfer material guide member during the developer install mode.

5. An image forming apparatus according to claim 1, further comprising an environment detection device which detects a temperature and a humidity of an environment, wherein, when a detection result of the environment detection device indicates a humidity higher than a predetermined humidity, the developer install mode is not performed, and when the detection result of the environment detection device indicates a humidity lower than the predetermined humidity, the developer install mode is performed.

6. An image forming apparatus, comprising:

an image bearing member;

a charging device which charges the image bearing member to a predetermined potential uniformly;

an exposure device which exposes the charged image bearing member to light according to an image signal to form an electrostatic latent image on the image bearing member in accordance with an image;

a developing device including a developer carrying member having a bias containing at least a direct current component applied thereto to supply developer to the image bearing member, and developing the electrostatic latent image by supplying the developer from the developer carrying member; and a control portion which sets a value of one or both of Vdc' and Vset so that the following expression is satisfied:

$$Vcont1 > Vcont2 > 0,$$

where Vcont1 represents a developing electric field for supplying the developer from the developer carrying member to the image bearing member at a time of an image formation, and Vcont1 is expressed as follows:

$$Vcont1 = |Vdc| - |V1|,$$

where Vdc represents a potential of the developer carrying member caused by the direct current component of the bias to be applied to the developing device, and V1 represents an image dark section potential on the image bearing member, and where Vcont2 represents a developing electric field for supplying the developer from the developer carrying member to the image bearing member at a time of a developer install mode for installing developer in the developing device at a time of non-image formation, and Vcont2 is expressed as follows:

Vcont2=|Vdc'|−|Vset|, where Vdc' represents a potential of the developer carrying member caused by a voltage of the direct current component of the bias to be applied to the developing device, and Vset represents a potential on the image bearing member charged by the charging device.

7. An image forming apparatus according to claim 6, wherein the control portion sets the potential Vdc of the developer carrying member caused by the voltage of the direct current component of the bias to be applied to the developing device at the time of the image forming operation and the potential Vdc' of the developer carrying member caused by the voltage of the direct current component of the bias to be applied to the developing device at the time of the developer install mode to a same value.

8. An image forming apparatus according to claim 6, further comprising a storage device which stores a cumulative number of revolutions of the developer carrying member from a developer replenishment start time, wherein the control portion controls the developing electric field Vcont2 at the time of the developer install mode so as to change the bias to be applied to one or both of the charging device and the developer carrying member in stages, every time the cumulative number of revolutions of the developer carrying member stored in the storage device reaches a predetermined cumulative number of revolutions.

9. An image forming apparatus according to claim 6, wherein the developing device comprises a developer remaining amount detection element which detects a remaining amount of the developer in a developing container, and wherein the control portion controls the developing electric field Vcont2 at the time of the developer install mode so as to change the bias to be applied to one or both of the charging device and the developer carrying member in stages, every time a number of detections of presence of the developer every predetermined time by the developer remaining amount detection element reaches a predetermined number.

10. An image forming apparatus, comprising:

an image bearing member;

a charging device which charges the image bearing member to a predetermined potential uniformly;

an exposure device which exposes the charged image bearing member to light according to an image signal to form an electrostatic latent image on the image bearing member in accordance with an image;

a developing device including a developer carrying member having a bias containing at least a direct current component applied thereto to supply developer to the image bearing member, and developing the electrostatic latent image by supplying the developer from the developer carrying member; and a control portion which sets a value of one or both of Vdc' and Vset so that the following expression is satisfied:

Vcont1>Vcont2>0, where Vcont1 represents the developing electric field for supplying the developer from the developer carrying member to the image bearing member at the time of the image formation, and Vcontl is expressed as follows:

Vcont1=(1/2)Vpp+|Vdc|−|V1|, where Vpp represents a potential of the developer carrying member caused by a peak-to-peak voltage application of an alternate current component when a bias containing a direct current component and the alternate current component superimposed on each other is applied to the developer carrying member, Vdc represents a potential of the developer carrying member caused by the direct current component, and V1 represents an image dark section potential on the image bearing member, and where Vcont2 represents a developing electric field for supplying the developer from the developer carrying member to the image bearing member at a time of a developer install mode for installing developer in the developing device at a time of non-image formation, and Vcont2 is expressed as follows:

Vcont2=|Vdc'|−|Vset|, where Vdc' represents a potential of the developer carrying member caused by a voltage of the direct current component of the bias to be applied to the developing device, and Vset represents a potential on the image bearing member charged by the charging device.

11. An image forming apparatus, comprising:

an image bearing member on which an electrostatic latent image is formed;

a charging device to which a bias is applied to charge the image bearing member;

an electrostatic latent image forming device configured to form the electrostatic latent image on the image bearing member charged by the charging device;

a developing device to which a bias is applied to form an electric field between the developing device and the image bearing member so that the developing device applies a charged developer to the image bearing member to develop the electrostatic latent image; and a control portion configured to control the developing device to form a weaker electric field between the developing device and the image bearing member so that the developing device applies a charged developer to the image bearing member in a developer install mode for installing developer in the developing device at a time of non-image formation than an electric field formed to develop the electrostatic latent image at a time of image formation.

12. An image forming apparatus according to claim 11, wherein, in the developer install mode, the control portion applies the bias to the developing device so that a potential difference between the image bearing member and the developing device is smaller than a potential difference between the developing device and an area corresponding to an image dark section on the image bearing member at the time of image formation.

13. An image forming apparatus according to claim 11, wherein, in the developer install mode, the control portion applies the bias to the developing device so that an absolute value of a potential of the developing device is smaller than an absolute value of a potential on the image bearing member.

14. An image forming apparatus according to claim 11, wherein the control portion sets Vdc representing a potential of the developing device caused by the bias applied to the developing device at the time of image formation and Vdc' representing a potential of the developing device caused by the bias applied to the developing device in the developer install mode to a same value.

15. An image forming apparatus according to claim 11, wherein, in the developer install mode, the control portion applies the bias to the charging device so that a potential difference between the image bearing member and the developing device is smaller than a potential difference between the developing device and an area corresponding to an image dark section on the image bearing member at the time of image formation.

16. An image forming apparatus according to claim 11, wherein, in the developer install mode, the control portion applies the bias to the charging device so that an absolute value of a potential on the image bearing member is smaller than an absolute value of a potential of the developing device.

17. An image forming apparatus according to claim 11, wherein, in the developer install mode, the control portion applies the bias to the charging device so that an absolute value of a potential on the image bearing member is larger than an absolute value of a potential of an image dark section on the image bearing member at the time of image formation.

18. An image forming apparatus according to claim 11, wherein the control portion sets one or both of a value of Vdc' representing a potential of the developing device caused by a voltage of the bias applied to the developing device and a value of Vset representing a potential on the image bearing member so that Vcont2 representing a developing electric field for supplying the developer from the developing device to the image bearing member in the developer install mode satisfies the following:

$$Vcont2=|Vdc'|-|Vset| \text{ and } Vcont1 > Vcont2 > 0,$$

where Vdc represents a potential of the developing device caused by the bias applied to the developing device, V1 represents a potential of an image dark section on the image bearing member, Vcont1 represents a developing electric field for supplying the developer from the developing device to the image bearing member, and the Vcont1 is expressed as $Vcont1=|Vdc|-|V1|$.

19. An image forming apparatus according to claim 18, wherein the developing device includes a developer carrying member configured to supply the developer to the image bearing member, the image forming apparatus further comprising:

a storage device which stores a cumulative number of revolutions of the developer carrying member from a developer replenishment start time; and a charging device configured to charge the image bearing member to a predetermined potential, wherein the control portion controls the developing electric field Vcont2 in the developer install mode so as to change one or both of a bias applied to the charging device and the bias applied to the developer carrying member in stages every time the cumulative number of revolutions of the developer carrying member stored in the storage device reaches a predetermined cumulative number of revolutions.

20. An image forming apparatus according to claim 17, wherein the developing device includes:

a developer carrying member configured to supply the developer to the image bearing member; and a developer remaining amount detection element configured to detect a remaining amount of the developer in a developing container, the image forming apparatus further comprising a charging device configured to charge the image bearing member to a predetermined potential, wherein the control portion controls the developing electric field Vcont2 in the developer install mode so as to change one or both of a bias applied to the charging device and the bias applied to the developer carrying member in stages every time a number of detections of presence of the developer detected by the developer remaining amount detection element for every predetermined time reaches a predetermined number.

* * * * *